US006515562B1

(12) United States Patent
Takenoshita et al.

(10) Patent No.: US 6,515,562 B1
(45) Date of Patent: Feb. 4, 2003

(54) CONNECTION STRUCTURE FOR OVERLAPPING DIELECTRIC WAVEGUIDE LINES

(75) Inventors: Takeshi Takenoshita, Soraku-gun (JP); Hiroshi Uchimura, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/298,399

(22) Filed: Apr. 23, 1999

(30) Foreign Application Priority Data

Apr. 23, 1998 (JP) ..... 10-113439
Aug. 31, 1998 (JP) ..... 10-244288

(51) Int. Cl.[7] ..... H01P 5/002
(52) U.S. Cl. ..... 333/248; 333/254
(58) Field of Search ..... 333/113, 114, 333/125, 136, 239, 248, 254

(56) References Cited

U.S. PATENT DOCUMENTS 2,478,317 A * 8/1949 Purcell ..... 333/114
2,519,734 A * 8/1950 Bethe ..... 333/113
2,647,950 A * 8/1953 Zaleski ..... 333/125
2,852,752 A * 9/1958 McCreary ..... 333/113 X
2,966,638 A 12/1960 Wheeler
5,982,256 A * 11/1999 Uchimura et al. ..... 333/239

FOREIGN PATENT DOCUMENTS

JP 6-053711 2/1994
JP 08-162813 6/1996
JP 10-075108 3/1998
JP 11-308025 11/1999

OTHER PUBLICATIONS

Uchimura, et al.: "Development of the Laminated Waveguide" Baltimore, MD Jun. 7–12, 1998.

* cited by examiner

*Primary Examiner*—Benny Lee
(74) *Attorney, Agent, or Firm*—Hogan & Hartson, LLP

(57) ABSTRACT

A connection structure for dielectric waveguide lines, which includes dielectric waveguide lines including dielectric substrates, a pair of main conductor layers, dielectric substrates parallel with one another being sandwiched therebetween, two rows of side-wall through conductor groups arranged at intervals less than one half of a signal wavelength in a transmission direction of high-frequency signals, so as to electrically connect the pair of main conductor layers, and a sub conductor layer disposed between each pair of main conductor layers in parallel with the main conductor layers and electrically connected with the side-wall through conductor groups. The waveguides are stacked so that the main conductor layers partly overlap each other to define an overlap part, in which a coupling window is formed. This allows design freedom and easy fabrication. In addition, dielectric waveguide lines may be stacked so that the transmission directions of high-frequency signals are orthogonal to each other and one of the main conductor layers. The main conductor layers overlap each other to define an overlap part, in which a coupling window is disposed. This provides a connection structure with little transmission loss and excellent transmission characteristics.

6 Claims, 20 Drawing Sheets

CONNECTION STRUCTURE FOR OVERLAPPING DIELECTRIC WAVEGUIDE LINES

BACKGROUND OF THE INVENTION

1. Field of the Invention

The present invention relates to a connection structure for connecting dielectric waveguide lines principally for use in transmitting high-frequency signals in the microwave or millimeter wave band.

2. Description of the Related Art

In recent years, research in mobile communications, inter-vehicular radars or the like in which high-frequency signals within the microwave or millimeter wave band are used, been increasingly carried out. As a transmission line for transmitting such high-frequency signals, coaxial lines, waveguide lines, dielectric waveguide lines, microstrip lines and the like are known.

Moreover, there has recently been proposed a dielectric waveguide line that is formed in a wiring substrate composed of laminated multiple dielectric layers. For example, Japanese Unexamined Patent Publication JP-A 6-53711 (1994) proposes a waveguide line which is formed by sandwiching a dielectric substrate between a pair of main conductor layers and forming side walls of two rows of via-holes which connect the main conductor layers to each other. Namely, in this waveguide line, the dielectric material is surrounded by the pair of main conductor layers and the via-holes as pseudo conductor walls thereby to use the region inside these conductor walls as a dielectric line for signal transmission.

Further, the inventors of the present invention proposed in Japanese Unexamined Patent Publication JP-A 10-75108 (1998) a dielectric waveguide line of a multilayer structure which is formed within a dielectric substrate. This is also referred to as a lamination type waveguide, in which a dielectric waveguide line as described above is composed of a dielectric layer, a pair of main conductor layers and through conductor groups such as via-hole groups, and in addition to the through conductor groups sub conductor layers are further provided to reinforce the side walls which serve as electrical walls. In the dielectric waveguide line as disclosed in JP-A 6-53711, if an electric field not parallel to the via-holes is generated within the waveguide, the electric field will leak through the side walls. According to the lamination type waveguide, however, the electric field will not leak owing to the sub conductor layers.

Such a dielectric waveguide line which can be disposed inside the wiring substrate or the like is originally intended for use as a transmission line in a multilayer wiring substrate mainly for microwaves and millimeter waves or in a package for housing a semiconductor device, and it can also be used as a feed line for an antenna which is integrated into the multilayer wiring substrate or the package for housing a semiconductor device to provide a sophisticated function.

In general, in the case of using transmission lines to constitute a high-frequency circuit, and in particular, in the case of forming a feed line for an array antenna or the like, it is necessary to connect the transmission lines to each other in a wiring circuit within the transmission lines or disposed on a branch circuit.

Such dielectric waveguide line may be stacked one over another, however, if downsizing and high integration is desired, it is necessary to connect the dielectric waveguide lines to each other. In the case of the conventional metallic waveguides, there is no need for a specific connection technique because three-dimensional connection can be done by simply bending the metallic waveguides.

With regard to the connection of the dielectric waveguide lines stacked one over another, the inventors of the present invention have already proposed a connection structure with feed pins formed by via-holes. This connection structure enables the connection between the dielectric waveguide lines which are stacked one over another within a dielectric substrate.

However, even in this connection structure, there still remain problems to be solved as follows.

For example, in the above connection structure, the feed pin functions as a mono-pole antenna of ¼ wavelength within the dielectric waveguide line. Accordingly, it is necessary to adjust the length of the feed pin to a quarter of the wavelength of a signal most desired to be transmitted. However, since the feed pin is formed by a through conductor such as a via-hole, the length thereof is restricted to the thickness of dielectric sheets which are laminated to form the dielectric substrate in which the dielectric waveguide line is formed. Of course the thickness of the dielectric sheets may be changed so that the feed pin is set to a desired length, which, however, causes a problem that adaptability to various designs is impaired, and consequently results in an increase in cost.

Further, electric current flows concentratedly in the feed pin, in particular, in the millimeter wave band, the electric current concentrates on the surface of the feed pin under the influence of skin effect, with the result that an energy loss due to the conductor resistance is large.

Furthermore, although the dielectric waveguide line may be used in a mode where the lamination plane of laminated dielectric sheets is parallel with the E plane of the waveguide, i.e., in a mode where the electric field is parallel to the lamination plane, in this case excitation of electric current will not occur in the feed pin making it impossible to connect the dielectric waveguide lines together when they are stacked one over another.

In addition, in the case of simply disposing a branch to a dielectric waveguide line for signal transmission surrounded by artificial conductor walls formed by the pair of conductor layers and the two rows of via holes, as proposed in JP-A 6-53711, the electromagnetic field is disturbed and large transmission loss occurs.

Therefore, in order to constitute a high-frequency circuit by producing a transmission line circuit provided with a branch for forming a feed line for an array antenna or the like within a dielectric substrate, such a branch structure for dielectric waveguide lines is desired that can be formed within a dielectric substrate, prevent radiation of electromagnetic waves and have minimal transmission loss.

SUMMARY OF THE INVENTION

The invention was made to solve the above-mentioned problems, and it is an object of the invention to provide a connection structure for dielectric waveguide lines which can be readily manufactured by the conventional multi-layering technique, the connection structure being capable of giving freedom of design and enabling easy connection of dielectric waveguide lines stacked one over another within a dielectric substrate.

It is another object of the invention to provide a connection structure for dielectric waveguide lines which can be readily manufactured by the conventional multi-layering technique, the connection structure being capable of easily connecting the dielectric waveguide lines which are stacked one over the other within a dielectric substrate so as to be orthogonal to each other.

It is still another object of the invention to provide a connection structure for dielectric waveguide lines in which dielectric waveguide lines can be formed within a dielectric substrate without radiation and leakage of electromagnetic waves of high-frequency signals, wherein the circuit can branch into a shape of T or a right-angled three-forked line, having little transmission loss and excellent transmission characteristics which is achieved by connecting one dielectric waveguide line to another one so as to intersect each other.

The inventors of the invention have made efforts for solving the above-mentioned problems and found that by stacking two dielectric waveguide lines formed within a dielectric substrate, one over the other so that a part of an upper main conductor layer of the dielectric waveguide line formed at the lower side and a part of a lower main conductor layer of the dielectric waveguide line formed at the upper side overlap each other, and providing a coupling window in the overlap part of the main conductors, the upper and lower dielectric waveguide lines can be electromagnetically coupled.

The invention provides a connection structure for dielectric waveguide lines, comprising two dielectric waveguide lines each including a dielectric substrate; a pair of main conductor layers, the dielectric substrate being sandwiched between the pair of main conductor layers; two rows of side-wall through conductor groups arranged in a transmission direction of high-frequency signals at intervals less than one half of a signal wavelength so as to electrically connect the main conductor layers; and a sub conductor layer disposed between the main conductor layers so as to be parallel with the main conductor layers, the sub conductor layer being electrically connected with the side-wall through conductor groups, the dielectric waveguide lines thereby transmitting high-frequency signals through a region surrounded by the main conductor layers, the side-wall through conductor groups and the sub conductor layer, wherein the two dielectric waveguide lines are stacked one over the other so that one of the main conductor layers of one dielectric waveguide line and one of the main conductor layers of the other dielectric waveguide line overlap each other to define an overlap part, in which a coupling window is formed.

In the invention, it is preferable that the dielectric waveguide line further includes an end through conductor group provided at a distance equal to or less than a guide wavelength of the high-frequency signals from a center which is a central position of a length of the coupling window in the transmission direction, in the transmission direction ($d \leqq \lambda$), which end through conductor group is arranged at intervals less than one half of the signal wavelength in a direction orthogonal to the transmission direction ($P1 < \lambda/2$) so as to electrically connect the main conductor layers, and an end sub conductor layer disposed between the main conductor layers so as to be parallel with the main conductor layers, and electrically connected to the sub conductor layer and the end through conductor group.

In the invention, it is preferable that the end through conductor group and end sub conductor layer are formed at a distance from an end of the coupling window in the transmission direction.

In the invention, it is preferable that the end through conductor group and end sub conductor layer are disposed at positions which are substantially in an end portion of the coupling window in the transmission direction.

As detailed above, according to the connection structure for dielectric waveguide lines of the invention, in the connection portion between the lower dielectric waveguide line and the upper dielectric waveguide line which are stacked one over the other within the dielectric substrate, the lower main conductor layer of the upper dielectric waveguide line and the upper main conductor layer of the lower dielectric waveguide line overlap each other so as to be used in common, and a portion which lacks for a main conductor layer is provided as a coupling window in the overlap part. As a result, the thickness of dielectric sheets constitutes no restriction on characteristics of the resulting waveguide line in contrast to the conventional connection structure via a feed pin. For example, since the pattern of the coupling window can be previously made when the overlap part of the main conductor layers of two dielectric waveguide lines is printed before lamination of green sheets, formation of the coupling window is facilitated and a connection structure of good productivity is realized with low production costs.

Further, in the case of forming the coupling window in the connection structure for dielectric waveguide lines of the invention, the position, profile and size of the coupling window are complicatedly related to the frequency characteristics, coupling amount and reflection amount which are required for the connection structure, and the connection structure of the invention has enhanced freedom of design as compared with the conventional method using a feed pin to facilitate circuit design.

Furthermore, since concentration of electric current on the surface of the feed pin as observed in the connection structure using the feed pin does not occur, an energy loss due to the connection between dielectric waveguide lines is small.

As mentioned above, the invention makes it possible to provide a connection structure for dielectric waveguide lines which can be easily fabricated by the conventional multi-layering technique, which connection structure offers freedom of circuit design and makes it possible to readily connect the dielectric waveguide lines stacked one over another.

Next, the inventors of the invention have found that by stacking two dielectric waveguide lines one over the other within a dielectric substrate so that the dielectric waveguide lines are orthogonal to each other and so that a part of an upper main conductor layer of the dielectric waveguide line formed at the lower side and a part of a lower main conductor layer of the dielectric line formed at the upper side overlap each other so as to be used in common, and by providing a coupling window for high-frequency signals in the partial main conductor used in common as a clear portion which lacks for a main conductor, the upper and lower dielectric waveguide lines can be electromagnetically coupled.

According to this connection structure, high-frequency signals inputted from one dielectric waveguide line can propagate through the coupling window into the other dielectric waveguide line on the output side which is orthogonal to the one dielectric waveguide line, in two directions in the same phase. The coupling window which lacks a conductor, disposed between two waveguide lines, is identical to a hole called a Bethe-hole in the conventional waveguide line and utilized for a branch structure or directional coupler.

Further, the inventors have also found that by increasing the width or decreasing the thickness of the two dielectric waveguide lines in the connection portion thereof, it is made possible to use the portion as a matching portion for impedance matching to reduce reflection of high-frequency signals due to noncontinuity of impedance.

The invention provides a connection structure for dielectric waveguide lines comprising two dielectric waveguide lines each including a dielectric substrate, a pair of main conductor layers, the dielectric substrate being sandwiched between the pair of main conductor layers, two rows of side-wall through conductor groups arranged in a transmission direction of high-frequency signals at repetition intervals less than one half of a signal wavelength in a transmission direction of high-frequency signals and in a direction orthogonal to the transmission direction at a predetermined width, so as to electrically connect the main conductor layers, and a sub conductor layer disposed between the main conductor layers so as to be parallel with the main conductor layers, the sub conductor layer being electrically connected with the side-wall through conductor groups, the two dielectric waveguide lines thereby transmitting high-frequency signals through a region surrounded by the main conductor layers, the side-wall through conductor groups and the sub conductor layer, wherein the two said dielectric waveguide lines are stacked one over the other so that the transmission directions of high-frequency signals thereof are orthogonal to each other and one of the main conductor layers of one dielectric waveguide line and one of the main conductor layers of the other dielectric waveguide line overlap each other, and a coupling window is formed in the overlap part of the main conductor layers.

Further, in the invention it is preferable that the dielectric waveguide line further includes an end through conductor group, provided at a distance equal to or less than a guide wavelength of the high-frequency signals from a center of the coupling window to the transmission direction of the dielectric waveguide line, which end through conductor group is arranged at intervals less than one half of the signal wavelength in a direction orthogonal to the transmission direction so as to electrically connect the main conductor layers, and an end sub conductor layer is disposed between the main conductor layers so as to be parallel with the main conductor layers, and to be electrically connected to the sub conductor layer and the end through conductor group.

Furthermore, in the invention it is preferable that a width of the two rows of side-wall through conductor groups of the dielectric waveguide lines in the overlap part of the dielectric waveguide lines is larger than the predetermined width.

In addition, in the invention it is preferable that an interval between the pair of main conductor layers of the dielectric waveguide lines in the overlap part of the dielectric waveguide lines is narrower than an interval therebetween in the remaining part.

According to the connection structure for dielectric waveguide lines of the invention, the first and second dielectric waveguide lines overlap each other so as to be orthogonal to each other, and a coupling window is disposed as a portion which lacks a conductor, in the main conductor layers in the overlap part, whereby the two dielectric waveguide lines are coupled by an electromagnetic field, and high-frequency signals inputted from one of the dielectric waveguide lines also propagate into the other dielectric waveguide line via the coupling window. Since there are two directions to propagate in the other dielectric waveguide line, the high-frequency signals propagate in the two directions, thereby branching into three directions including the two directions and the transmission direction in the first dielectric waveguide line.

Further, according to the connection structure for dielectric waveguide lines of the invention, in the above configuration, the end face through conductor groups and the end sub conductor layers are provided at a predetermined distance from the center of the coupling window, and hence when the end face through conductor groups and the end sub conductor layers are provided in one of the dielectric waveguide lines, it is possible to branch the propagation of high-frequency signals in a T-shaped configuration. When the end face through conductor groups and the end sub conductor layers are provided in both the dielectric waveguide lines, it is possible to cause high-frequency signals to propagate in an L-shaped configuration.

Furthermore, according to the connection structure for dielectric waveguide lines of the invention, in the above configuration, by increasing the width of at least one of the dielectric waveguide lines in the overlap part of the dielectric waveguide lines, i.e., the width between the side-wall through conductor groups in a direction orthogonal to the transmission direction, or decreasing the thickness of at least one of the dielectric waveguide lines in the overlap part of the dielectric waveguide lines, i.e., the distance between the pair of main conductor layers, it is possible to reduce the discontinuity of impedance of the dielectric waveguide lines at the connection portion to realize connection with little reflection of high-frequency signals and small transmission loss. Thus increasing the width or decreasing the thickness may be made for both the dielectric waveguide lines and the combination thereof may be made.

As described above, according to the connection structure for dielectric waveguide lines of the invention, in any of the configurations, it is possible to reduce a mismatch of the characteristic impedance of the dielectric waveguide lines before and after the connection portion to thereby decrease reflection of high-frequency signals at the connection portion, and moreover to prohibit disturbance of a propagation mode at the connection portion, with the result that such a connection structure for dielectric waveguide lines can be obtained that shows little transmission loss and has excellent transmission characteristic.

In other words, according to the connection structure for dielectric waveguide lines of the invention, at the connection portion of the lower dielectric waveguide line and the upper dielectric waveguide line which are stacked one over the other so that the transmission directions are orthogonal to each other within a dielectric substrate, one of the main conductor layers, i.e., the upper main conductor layer of the lower dielectric waveguide line and the lower main conductor layer of the upper waveguide line overlap each other, and a coupling window is disposed in the overlap part of the main conductor layers, whereby the two dielectric waveguide lines are coupled by an electromagnetic field, and high-frequency signals inputted from one of the dielectric waveguide lines also propagate into the other dielectric waveguide line via the coupling window. Since there are two directions of propagation of signals in the other dielectric waveguide line, the high-frequency signals propagate in the two directions, whereby propagation of signals is branched into three directions including the two directions and the transmission direction in the first dielectric waveguide line.

Further, according to the connection structure for dielectric waveguide lines of the invention, in the above configuration, the end face through conductor groups and the end sub conductor layers are provided at a predetermined distance from the center of the coupling window, so that when they are provided in one of the dielectric waveguide lines, it is possible to branch the propagation of high-frequency signals in a T-shaped configuration and when the end face through conductor groups and the end sub conductor layers are provided in both the dielectric waveguide lines, it is possible to make high-frequency signals propagate in an L-shaped configuration.

Furthermore, according to the connection structure for dielectric waveguide lines of the invention, in the above configuration, by increasing the width of at least one of the dielectric waveguide lines in the overlap part of the dielectric waveguide lines, i.e., the width between the side-wall through conductor groups in a direction orthogonal to the transmission direction, or decreasing the thickness of at least one of the dielectric waveguide lines in the overlap part of the dielectric waveguide lines, i.e., the distance between the pair of main conductor layers, it is possible to reduce the discontinuity of impedance of the dielectric waveguide lines at the connection portion to realize connection with little reflection of high-frequency signals and small transmission loss.

As shown above, according to the invention, it is possible to provide a connection structure for dielectric waveguide lines which can be readily manufactured by the conventional multi-layering technique, the connection structure being capable of easily connecting the dielectric waveguide lines stacked one over the other so as to be orthogonal to each other within a dielectric substrate.

Further, according to the invention, it is possible to provide such a connection structure for dielectric waveguide lines that can be formed in a dielectric substrate without radiation and leakage of electromagnetic waves of high-frequency signals, the connection structure capable of connecting two dielectric waveguide lines so as to be branched into a shape of T or into three lines intersecting at right angles with a little transmission loss and good transmission characteristics.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
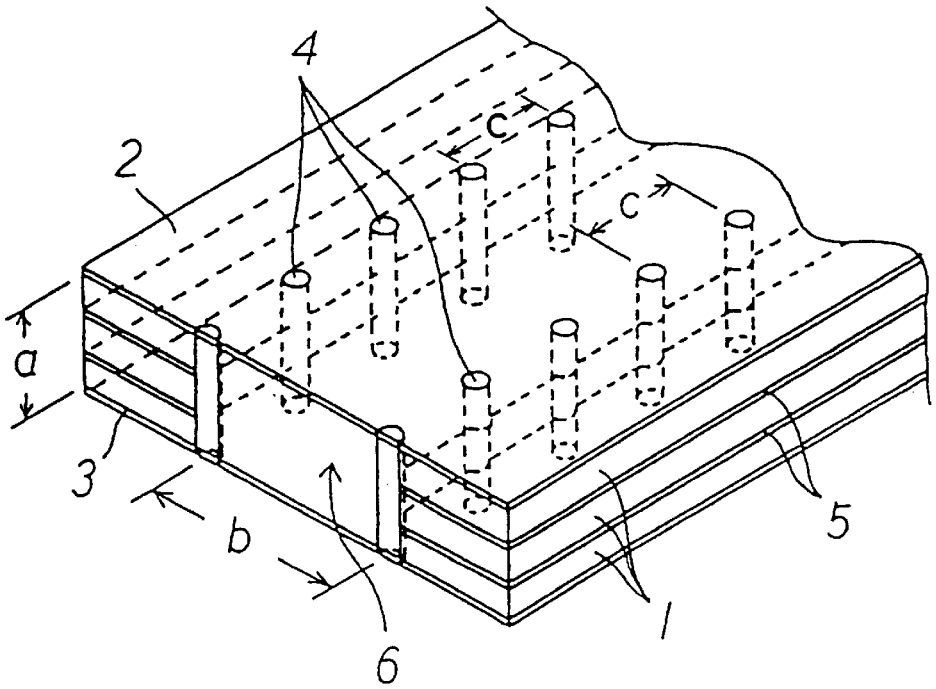
FIG. 1 is a schematic perspective view showing an example of a configuration of a dielectric waveguide line used in the present invention.

Now referring to the drawings, preferred embodiments of the invention are described below.

In the following, a connection structure for dielectric waveguide lines of the invention will be explained with reference to the drawings.

FIG. 1 is a perspective view schematically showing an example of a configuration of a dielectric waveguide line used in the invention.

In FIG. 1, a dielectric substrate 1 is sandwiched between a pair of main conductor layers 2, 3, and two rows of side-wall through conductor groups 4 are arranged at intervals shorter than one half of a signal wavelength in a signal transmission direction so as to electrically connect the main conductor layers 2, 3. Sub conductor layers 5 are disposed in parallel with the main conductor layers 2, 3 so as to electrically connect the through conductors constituting each row of side-wall through conductor groups 4. The pair of main conductor layers 2, 3, the side-wall through conductor groups 4 and the sub conductor layers 5 constitute a dielectric waveguide line 6. Reference numerals composed of a number and a subscript L, U which are mentioned later and used in the drawings may be presented only by the number in a mass. In FIGS. 2, 3A to 11C, for in comprehending the drawings, components are diagonally shaded.

By thus providing the sub conductor layers 5 in a region surrounded by the pair of main conductor layers 2, 3 and the side-wall through conductor groups 4, the side wall has a close grid pattern made by the side-wall through conductor groups 4 and the sub conductor layers 5 when seen from inside of the dielectric waveguide line 6, so that electromagnetic waves of various directions can be shielded. The sub conductor layers 5 are orthogonal to the side-wall through conductor groups 4 and are formed into, for example, flat slender boards.

Figure 2:
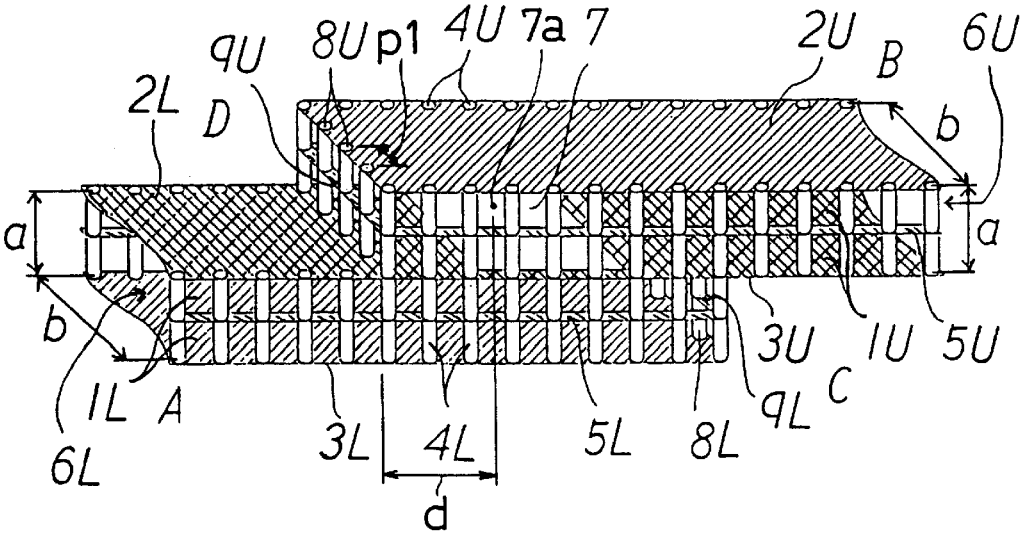
FIG. 2 is a schematic perspective view showing one embodiment of a connection structure for dielectric waveguide lines according to the invention.

As shown in FIG. 1, the pair of main conductor layers 2, 3 is disposed so as to sandwich the dielectric substrate 1 having a predetermined thickness a, and the main conductor layers 2, 3 are disposed on the upper and lower surfaces of the dielectric substrate 1, which surfaces sandwich at least a region where the dielectric waveguide line 6 is formed. Between the main conductor layers 2 and 3, also provided is a plurality of through conductors for electrically connecting the main conductor layers 2 and 3 such as through-hole conductors or via-hole conductors, whereby the two rows of side-wall through conductor groups 4 are configured. In FIG. 1, two sub conductor layers 5 are provided for each dielectric waveguide line 6 in the direction of the thickness thereof. However, in other embodiments, a single sub conductor layer 5 may be provided as shown in FIG. 2, and in other examples, three or more sub conductor layers 5 may be provided. In FIGS. 3A to 11C mentioned later, for preventing the drawings from being complicated, the side-wall through conductor groups 4 and the sub conductor layers 5 are simplified.

The two rows of side-wall through conductor groups 4 are formed with a predetermined space (width) b therebetween and arranged at predetermined intervals c shorter than one half of a signal wavelength in a transmission direction of a high-frequency signal, thereby forming electrical side walls of the dielectric waveguide line 6.

There is no special restriction for the thickness a of the dielectric substrate 1, i.e., the interval between the pair of main conductor layers 2 and 3, however, the thickness a is preferably in a range between one half of the space to twice the space b ($b/2<a<2\cdot b$) when the dielectric waveguide line is used in a single mode. In the example of FIG. 1 where the thickness a is about one half of the space b, a portion corresponding to the H plane of the dielectric waveguide line is formed by the main conductor layers 2, 3, and a portion corresponding to the E plane thereof is formed by the side-wall through conductor groups 4 and the sub conductor layers 5. Alternatively, in the case where the thickness a is about twice the space b ($a=2\cdot b$), a portion corresponding to the E plane of the dielectric waveguide line is formed by the main conductor layers 2, 3, and a portion corresponding to the H plane thereof is formed by the side-wall through conductor groups 4 and the sub conductor layers 5.

The single mode is one of the modes of electromagnetic waves propagating within a dielectric waveguide line whose section orthogonal to the axial line is rectangular, and is observed in the lowest frequency, which mode can be referred to as a normal mode or a TE10 mode. For example, a magnetic field propagating in the TE10 mode repeatedly shows alternation of a right spiral and a left spiral, and the portion corresponding to the H plane is a plane parallel with a plane where the magnetic field is spirally formed. The portion corresponding to the E plane is a plane orthogonal to the portion corresponding to the H plane.

Further, by determining the interval c to be less than one half of a signal wavelength $\lambda$ ($c<\lambda/2$), electrical walls can be formed by the side-wall through conductor groups 4. Preferably, the interval c is less than one fourth of the signal wavelength ($c<\lambda/4$).

Since a TEM wave can propagate between the pair of main conductor layers 2, 3 disposed in parallel with each other, when the interval c of the side-wall through conductor groups 4 is more than one half ($\lambda/2$) of a signal wavelength $\lambda$ ($c>\lambda/2$), an electromagnetic wave supplied to the dielectric waveguide line 6 is caused to leak from between the side-wall conductors 4 and prevented from propagating along the artificial waveguide created in this case. By contrast, when the interval c of the side-wall through conductor groups 4 is less than $\lambda/2$ ($c<\lambda/2$), the electromagnetic wave cannot propagate in a direction orthogonal to the dielectric waveguide line 6, so that it propagates in the signal transmission direction of the dielectric waveguide line 6 while being reflected. Therefore, in the configuration of FIG. 1, a region having a section area of $a\times b$, surrounded by the pair of main conductor layers 2, 3, the two rows of side-wall through conductor groups 4 and the sub conductor layers 5 is referred to as the dielectric waveguide line 6.

In the example illustrated in FIG. 1, the side-wall through conductor groups 4 are disposed in two rows, however, it is also possible to dispose the side-wall through conductor groups 4 in four or six rows to form double or triple artificial conductor walls by means of the side-wall through conductor groups 4, in order to prevent leakage of electromagnetic waves from the conductor walls more efficiently.

Since the above-mentioned dielectric waveguide line 6 forms a transmission line based on a dielectric waveguide, the size of the waveguide is $1/\sqrt{\epsilon_r}$ of that of the conventional hollow waveguides when a dielectric constant of the dielectric substrate 1 is referred to as $\epsilon_r$. Accordingly, the larger the dielectric constant $\epsilon_r$ of a material forming the dielectric substrate 1, the smaller the size of a waveguide can be made, allowing the dielectric waveguide line 6 to have a good size for use as transmission lines of multilayer wired substrates bearing high-density wiring, packages for housing a semiconductor device or inter-vehicular radars.

The through conductors constituting the side-wall through conductor groups 4 are arranged at intervals c shorter than one half of the signal wavelength $\lambda$ as described above, and the interval c is preferably a constant repetition interval in order to realize sufficient transmission characteristics. However, it is obvious that the interval c may be changed appropriately or may be a combination of some different intervals insofar as the interval is less than one half of the signal wavelength $\lambda$ ($c<\lambda/2$).

The dielectric substrate 1 constituting the above-mentioned dielectric waveguide line is not particularly restricted as far as it functions as a dielectric and has characteristics which do not disturb the transmission of high-frequency signals, but preferably the dielectric substrate 1 is formed of ceramics from the viewpoint of accuracy in forming a transmission line and ease of the production.

As such ceramics, ceramics having various dielectric constants have been known hitherto, however, paraelectric materials are preferable for the purpose of transmitting high-frequency signals by the dielectric waveguide line according to the invention. This is because ferroelectric ceramics cause a high dielectric loss in a high-frequency region and hence the transmission loss is large. Therefore, it is appropriate to set the dielectric constant $\epsilon_r$ of the dielectric substrate 1 to be about 4 to 100.

Usually, the line width of a wiring layer formed in multilayer wiring substrates, packages for housing a semiconductor device or inter-vehicular radars is about 1 mm at the maximum. When a material having a dielectric constant of 100 is used and the line is used so that the upper portion is the H plane, i.e., the electromagnetic field distribution in which the magnetic field is spirally formed so as to be parallel with the upper face is produced, therefore, the minimum available frequency is calculated to be 15 GHz, and hence the line can be used also in the microwave band region.

By contrast, since a dielectric formed of a synthetic resin which is generally used as the dielectric substrate 1 has a dielectric constant $\epsilon_r$ of about 2, the line cannot be used unless the frequency is about 100 GHz or higher when the line width is 1 mm.

Such paraelectric ceramics include many ceramics having a very small dielectric loss tangent, such as alumina and silica. However, not all kinds of paraelectric ceramics can be used. In the case of using a dielectric waveguide line, almost no loss is caused by a conductor, and the loss in the signal transmission is mainly caused by a dielectric. A loss $\alpha$ (dB/m) due to a dielectric can be expressed by a formula 1 as shown below:

$$\alpha=27.3\times\tan\delta/[\lambda/\{1-(\lambda/\lambda c)^2\}^{1/2}] \quad (1)$$

wherein tan $\delta$: dielectric loss tangent of the dielectric $\lambda$: wavelength in the dielectric $\lambda c$: cut-off wavelength In conformance with standardized shapes of a rectangular waveguide (WRJ series), $\{1-(\lambda/\lambda c)^2\}^{1/2}$ in the above expression 1 is about 0.75.

The WRJ series is a standard of the size of rectangular waveguides in Japan. For example, a rectangular waveguide called WRJ-60 has a section shape orthogonal to the axis thereof which has an internal dimension of 3.76 mm×1.88 mm, and is used in a frequency band region of 50 to 75 GHz. The WRJ series can be expressed by a WR series, which is a revised Japanese standard.

Therefore, in order to reduce the loss to a practically available level of transmission loss of −100 dB/m or less, it is necessary to select a dielectric so as to satisfy the relationship of a formula 2 as shown below:

$$f\times\epsilon_r^{1/2}\times\tan\delta\leqq 0.8 \quad (2)$$

wherein f is a frequency to be used (GHz).

A material of the dielectric substrate 1 includes alumina ceramics, glass ceramics, aluminum nitride ceramics and the like. For example, the substrate is produced in the following manner. An appropriate organic solvent is added to and mixed with powder of a ceramics raw material, made into a slurry form. The mixture is formed into a sheet-like shape by using a well-known technique such as the doctor blade method or the calender roll method, to obtain plural ceramic green sheets. These ceramic green sheets are subjected to an appropriate punching process and then laminated. Thereafter, fixing is conducted at 1,500 to 1,700° C. in the case of alumina ceramics, at 850 to 1,000° C. in the case of glass ceramics or at 1,600 to 1,900° C. in the case of aluminum nitride ceramics.

The pair of main conductor layers 2, 3 is formed in the following manner. In the case where the dielectric substrate 1 is made of alumina ceramics, for example, an oxide such as alumina, silica or magnesia, an organic solvent and the like are added to and mixed with powder of a metal such as tungsten, made into a paste-like form. The mixture is then printed onto the ceramic green sheets by the thick film printing technique so as to completely cover at least a transmission line. Thereafter, firing is conducted at a high temperature of about 1,600° C., thereby forming the main conductor layers 2, 3 having a thickness of 10 to 15 $\mu$m or more. As the metal powder, preferably, copper, gold or silver is used in the case of glass ceramics, and tungsten or molybdenum is used in the case of aluminum nitride ceramics. Usually, the thickness of the main conductor layers 2, 3 is set to be about 5 to 50 $\mu$m.

The through conductors constituting the side-wall through conductor groups 4 may be formed by, for example, via-hole conductors or through hole conductors. The through conductors may have a circular section shape which can be easily produced, or alternatively a section shape of a polygon such as a rectangle or a rhomboid may be used. These through conductors are formed by, for example, embedding metal paste similar to the main conductor layers 2, 3 into through holes which are formed by conducting a punching process on a ceramic green sheet, and then firing the metal paste together with the dielectric substrate 1. It is suitable to set the diameter of these through conductors to be 50 to 300 $\mu$m.

Next, referring to FIG. 2, one embodiment of a connection structure for dielectric waveguide lines of the invention which uses the above-described dielectric waveguide line will be described.

FIG. 2 is a schematic perspective view showing one embodiment of a connection structure for dielectric waveguide lines according to the invention. In FIG. 2, reference symbol L denotes elements belonging to the lower dielectric waveguide line of dielectric waveguide lines stacked one over the other, and reference symbol U denotes elements belonging to the upper dielectric waveguide line. Reference numeral 1L(1U) denotes a dielectric substrate having a thickness a; reference numerals 2L(2U), 3L(3U) denote a pair of main conductor layers disposed so as to sandwich the dielectric substrate 1L(1U); reference numeral 4L(4U) denotes two rows of side-wall through conductor groups, formed with a predetermined space (width) b therebetween and arranged at predetermined intervals c less than one half of a signal wavelength in a transmission direction of high-frequency signals, so as to electrically connect the main conductor layers 2L(2U) and 3L (3U); reference numeral 5L(5U) denotes a sub conductor layer; and reference numeral 6L(6U) denotes a dielectric waveguide line configured by a region surrounded by the pair of main conductor layers 2L(2U), 3L(3U), the two rows of side-wall through conductor groups 4L(4U) and the sub conductor layer 5L(5U).

These dielectric substrate 1L(1U), main conductor layers 2L(2U), 3L(3U) and side-wall through conductor groups 4L(4U) are configured in the same manner as described for the dielectric waveguide line used in the invention mentioned before.

Furthermore, a coupling window 7 for electromagnetically coupling between the upper dielectric waveguide line 6U and the lower dielectric waveguide line 6L is provided in the following manner: the dielectric waveguide line 6U and the dielectric waveguide line 6L are stacked so that the main conductor layer 3U and the main conductor layer 2L overlap each other to define an overlap part; and thereafter a clear portion is formed in the overlap part of the main conductor layers 3U and 2L to thereby constitute the coupling window 7. "The overlap part" of the main conductor layers 3U and 2L may be configured by making two main conductor layers 3U, 2L which are individual into contact with each other in the direction of the thickness thereof and electrically connecting. Otherwise, it may be configured by omitting one of two main conductor layers 3U, 2L in the overlap part to leave the other and electrically connecting the rest part of the main conductor layers 3U, 2L.

According to the invention, at a connection portion between the lower dielectric waveguide line 6L and the upper dielectric waveguide line 6U, the upper and lower dielectric waveguide line 6U and 6L are stacked so that the upper main conductor layer 2L of the lower dielectric waveguide line 6L and the lower main conductor 3U of the upper dielectric waveguide line 6U partly overlap each other and made into contact with each other, and a clear portion of the main conductor layer 3U(2L) serving as the coupling window 7 is formed in the overlap part. As a result, the clear portion serves as an electromagnetic coupling window, so that the lower dielectric waveguide line 6L and the upper dielectric waveguide line 6U are electromagnetically coupled to each other via this coupling window 7.

According to the connection structure for dielectric waveguide lines of the invention, characteristics are not restricted by the thickness of a dielectric sheet as restricted in the prior art in which coupling is conducted via a feed pin. For example, a pattern of the coupling window 7 can be formed at the time of printing the overlap part of the main conductor layers 3U, 2L of the two dielectric waveguide lines 6U, 6L before laminating green sheets which are to become the dielectric substrates 1U, 1L, with the result that high productivity and low cost production can be realized.

Furthermore, in the case of using a feed pin, all the energy of propagated electromagnetic waves is passed through the feed pin at first, thereafter to be converted to current energy. In this case, since the feed pin has a certain resistance unless it is a superconductor, heat is generated to cause an energy loss at the connection portion. On the contrary, according to the connection structure for dielectric waveguide lines of the invention, since the energy of electromagnetic waves having propagated through the lower dielectric waveguide line 6L is directly coupled with the energy of electromagnetic waves of the upper dielectric waveguide line 6U via the coupling window 7, an energy loss as described above will not occur.

In the connection structure for dielectric waveguide lines of the invention, in the case of forming the coupling window 7, the position, profile and size thereof are related complicatedly to the frequency characteristics, coupling amount and reflection amount required for the connection structure. For this reason, calculations using the electromagnetic field analysis are repeatedly executed so as to satisfy the desired frequency characteristics, whereby the position, profile, size and the like of the coupling window 7 having desired connection characteristics are determined.

In FIG. 2, in order to form an end on the connection portion of the dielectric waveguide line 6U(6L), there are provided: an end through conductor group 8U(8L), disposed at every distance equal to or shorter than a signal wavelength ($d \leqq \lambda$) in the transmission direction of high-frequency signals from the center 7*a* (see FIG. 3A) of the coupling window 7 and arranged at intervals less than one half of the signal wavelength $\lambda$ ($P1 < \lambda/2$) in a direction orthogonal to the transmission direction, so as to electrically connect the main conductor layers 2U and 3U (2L and 3L); and an end sub conductor layer 9U(9L) disposed between the main conductor layers 2U and 3U (2L and 3L) in parallel with the main conductor layers 2U, 3U(2L, 3L), the end sub conductor layer being electrically connected with the sub conductor layer 5U(5L) and the end through conductor group 8U (8L).

In that case, an electromagnetic wave inputted from the side A (left-hand in FIG. 2) of the lower dielectric waveguide line 6L is coupled to the upper dielectric waveguide line 6U via the coupling window 7 and outputted from the side B (right-hand in FIG. 2). In connection with this, positions of the ends on the connection portion of the dielectric waveguide lines 6L and 6U, that is, positions where the end through conductor groups 8U, 8L and the end sub conductor layers 9U and 9L are to be formed may be calculated by use of the electromagnetic field analysis according to the desired characteristics. Any position is possible as far as the desired characteristics are satisfied, however, it is optimal to set the positions at a distance not longer than a guide wavelength from the center 7*a* of the coupling window 7 in the transmission direction ($d \leqq \lambda$). Based on the positions of the conductor groups 8U, 8L and sub conductor layers 9U, 9L at the ends along the transmission direction, a phase at the center 7*a* of the coupling window 7 is adjusted. The reason why a position at a distance not longer than the guide wavelength in the transmission direction from the center 7*a* which is a central position of the length w of the coupling window along the transmission direction is optimum as a position along the transmission direction of the end through conductor groups is that the phase at the center 7*a* is repeated every guide wavelength $\lambda g$.

Such end portions of the dielectric waveguide lines 6U, 6L in the forms of the end through conductor groups 8U, 8L and the end sub conductor layers 9U, 9L can be provided in accordance with the purpose, but not necessarily be provided. In the case where the conductor groups 8U and the sub conductor layers 9U at the end of the dielectric waveguide line 6U are formed while the conductor groups 8L and the sub conductor layers 9L at the end of the dielectric waveguide line 6L are not, for example, an electromagnetic wave inputted from the side A of the dielectric waveguide line 6L is branched at the coupling window 7 to be partly outputted from the side B of the dielectric waveguide line 6U, and to be partly coupled to the dielectric waveguide line 6L and directly propagated in the direction C (right-hand direction in FIG. 2). In other words, this case corresponds to a branch circuit in which an electromagnetic wave is branched into upper and lower waveguides.

Alternatively, in the case where the conductor groups 8L, and the sub conductor layer 9L at the end of the dielectric waveguide line 6L are formed while the conductor layers 8U and the sub conductor layer 9U at the end surface of the dielectric waveguide line 6U are not, an electromagnetic wave inputted from the side A of the dielectric wavelength line 6L is fully coupled via the coupling window 7 to the dielectric waveguide line 6U, and then branched and propagated into the direction of the side B of the dielectric waveguide line 6U and the direction of the side D (left-hand direction in FIG. 2) of the dielectric waveguide line 6U. In other words, this case corresponds to a branch circuit on the upper dielectric waveguide line.

Next, examples of the connection structure for dielectric waveguide lines of the invention are illustrated in FIGS. 3A, 3B, 4A, 4B, 5A, 5B, 6A, 6B, 7A and 7B.

FIGS. 3A, 4A, 5A, 6A and 7A are schematic perspective views of a connection structure, and FIGS. 3B, 4B, 5B, 6B and 7B are diagrams showing frequency characteristics of transmission characteristics of the connection structure. In the diagrams of FIGS. 3B, 4B, 5B, 6B and 7B, the horizontal axis denotes frequency ($GH_z$), the vertical axis denotes S parameter (dB), and characteristic curves represent $S_{11}$ (reflection) and $S_{21}$ (transmission) among the S parameters. In each perspective view, the same elements are denoted by the same reference numerals as used in FIGS. 1 and 2, an open end of the dielectric waveguide line 6L(6U) and the coupling window 7 are diagonally shaded, the side-wall through conductor groups 4L(4U) and the end through conductor group 8L(8U) are simplified, and illustration of the sub conductor layers 5L, 5U and the end sub contractor layers 9U, 9L are omitted. The transmission characteristics are determined by simulation.

Figure 3A:
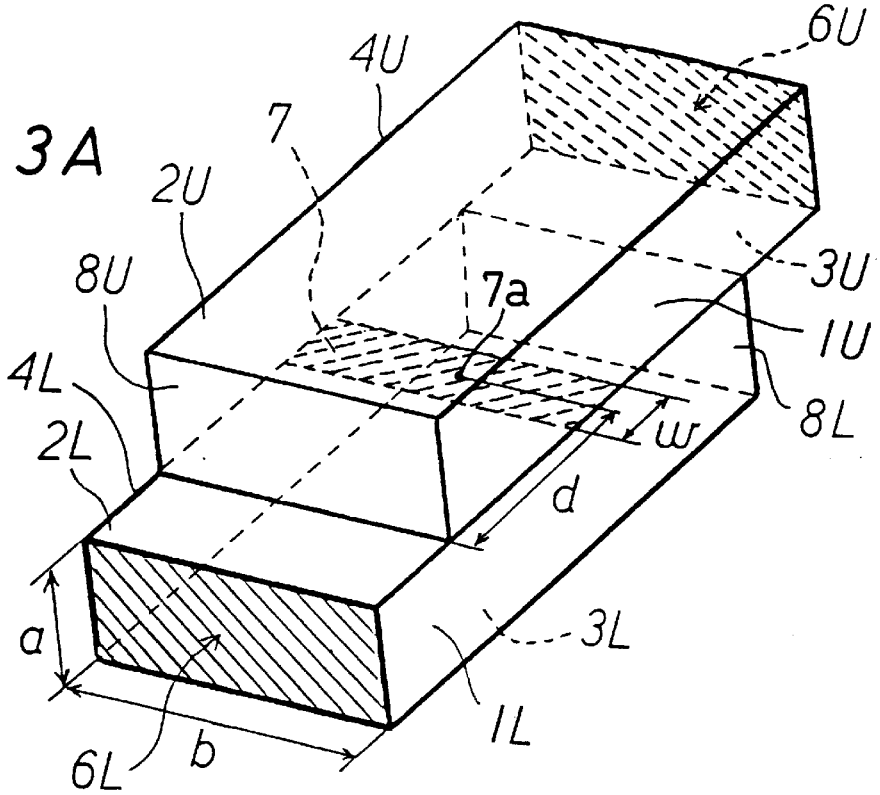
FIG. 3A is a perspective view showing an example of the connection structure for dielectric waveguide lines according to the invention.
Figure 3B:
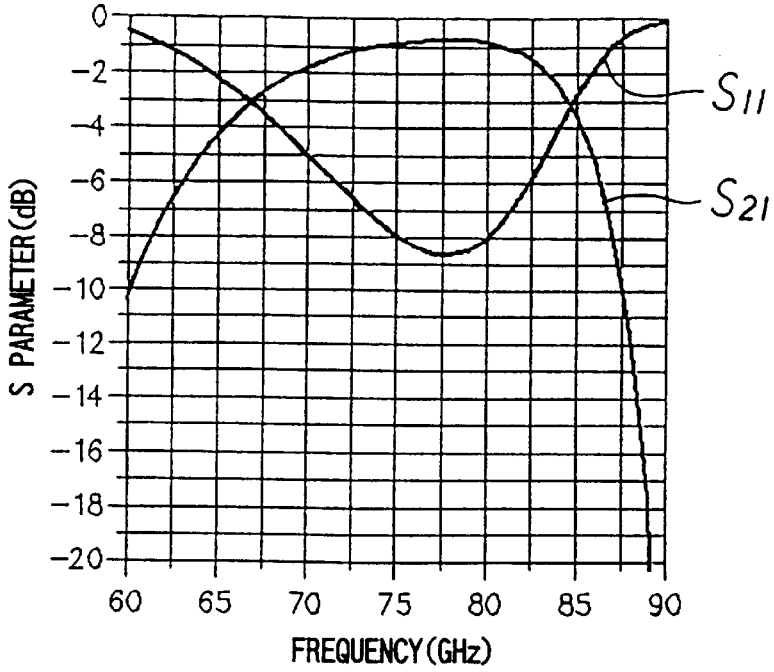
FIG. 3B is a diagram showing a frequency characteristic in transmission characteristics of the example of FIG. 3A.

At first, FIGS. 3A and 3B show an example where the thickness a of the dielectric substrate 1L(1U) is 0.6 mm, the space (width) b of the side-wall through conductor groups 4L(4U) is 1.456 mm, a distance d from the center 7*a* of the coupling window 7 to the end through conductor group 8L(8U) is 1.2 mm, the width of the coupling window 7 is equal to the space (width) b of the side-wall through conductor groups 4L(4U), and a length w in the transmission direction of the coupling window 7 is 0.4 mm. In this example, it is seen from FIG. 3B that the best transmission is obtained at a frequency of 77.5 $GH_z$. However, the reflection at the best transmission is about −9 dB, which has room for improvement.

Figure 4A:
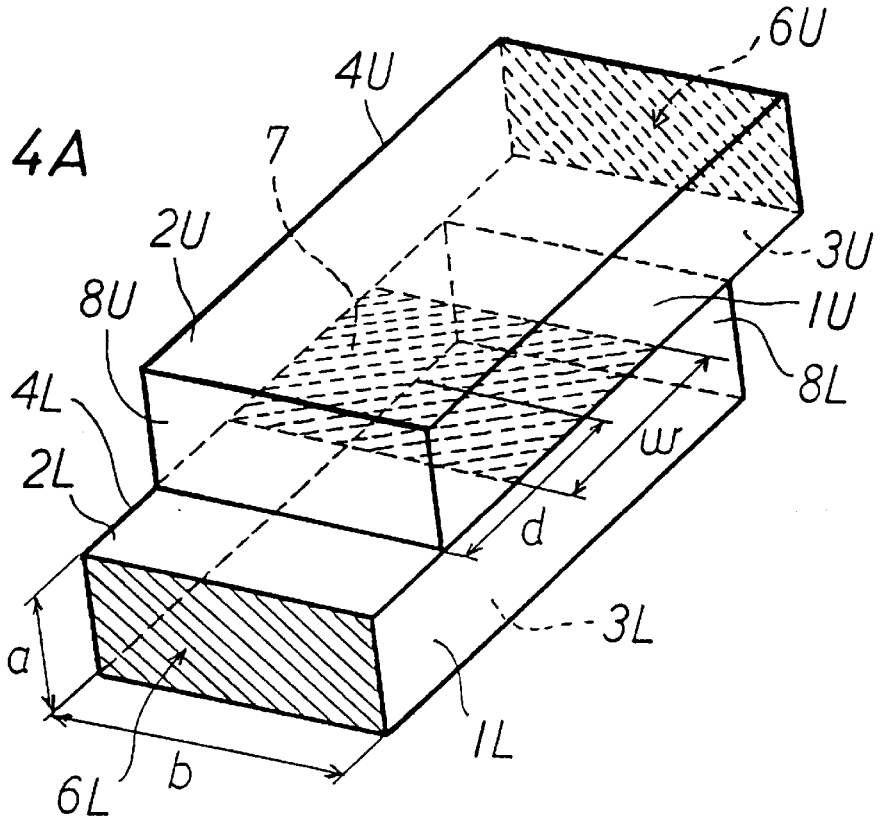
FIG. 4A is a perspective view showing another example of the connection structure for dielectric waveguide lines according to the invention.
Figure 4B:
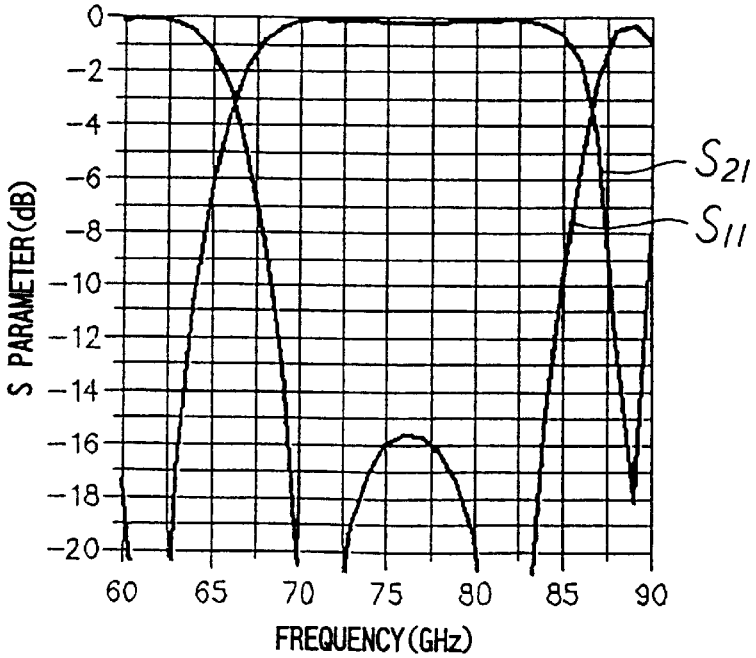
FIG. 4B is a diagram showing a frequency characteristic in transmission characteristics of the example of FIG. 4A.

In view of the above, as shown in FIGS. 4A and 4B, when the length w is elongated to 1.2 mm while the thickness a, the space (width) b and the distance d are equal to those of FIG. 3, electromagnetic waves in a wide bandwidth of 70 $GH_z$ to 82 $GH_z$ are transmitted with sufficient characteristics, that is, with a reflection not more than −15 dB.

Figure 5A:
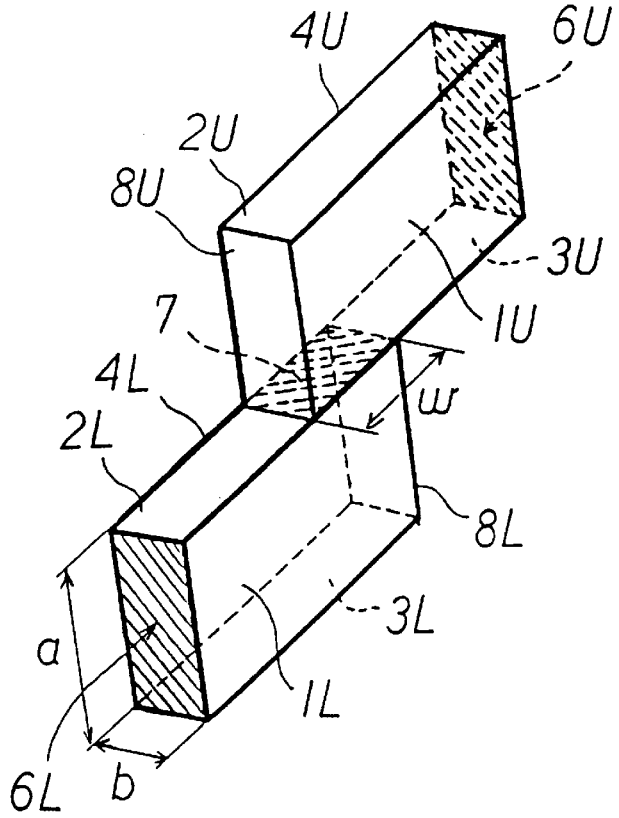
FIG. 5A is a perspective view showing still another example of the connection structure for dielectric waveguide lines according to the invention.
Figure 5B:
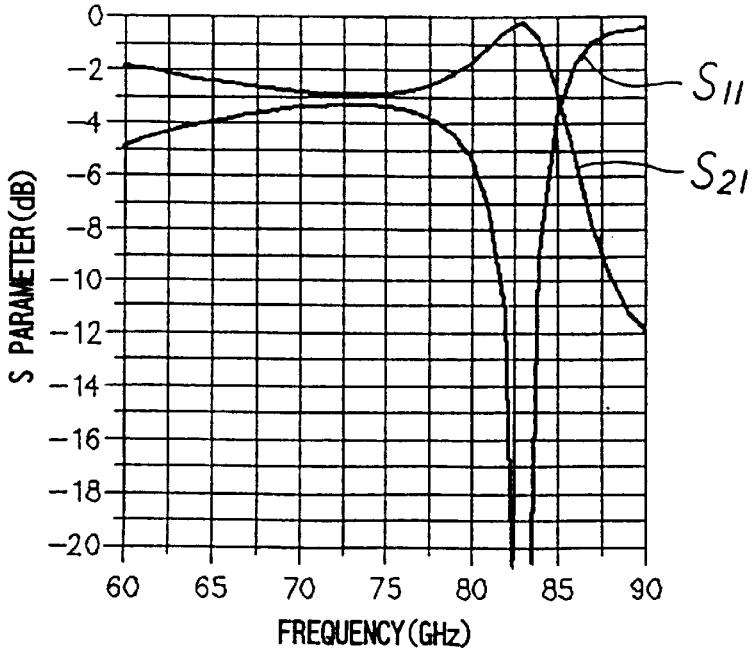
FIG. 5B is a diagram showing a frequency characteristic in transmission characteristics of the example of FIG. 5A.

FIGS. 5A and 5B show an example where the thickness a is 1.456 mm, the space (width) b is 0.6 mm, the length w is 1.2 mm, and limits of the coupling window 7 are made to substantially coincide with the positions of the ends of the dielectric waveguide lines 6L, 6U (d=w/2). The direction of the electric field is horizontal, and the main conductor layers 2L, 3L; 2U, 3U constitute the E planes. In this example, the best transmission of electromagnetic waves is obtained at a frequency of 83 $GH_z$, however, the frequency band permitting transmission is not so extensive.

Figure 6A:
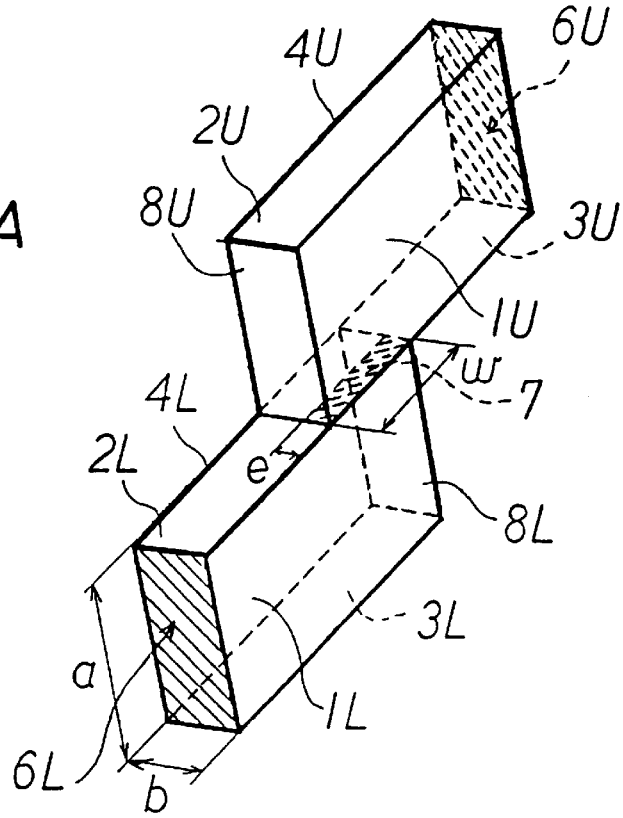
FIG. 6A is a perspective view showing yet still another example of the connection structure for dielectric waveguide lines according to the invention.
Figure 6B:
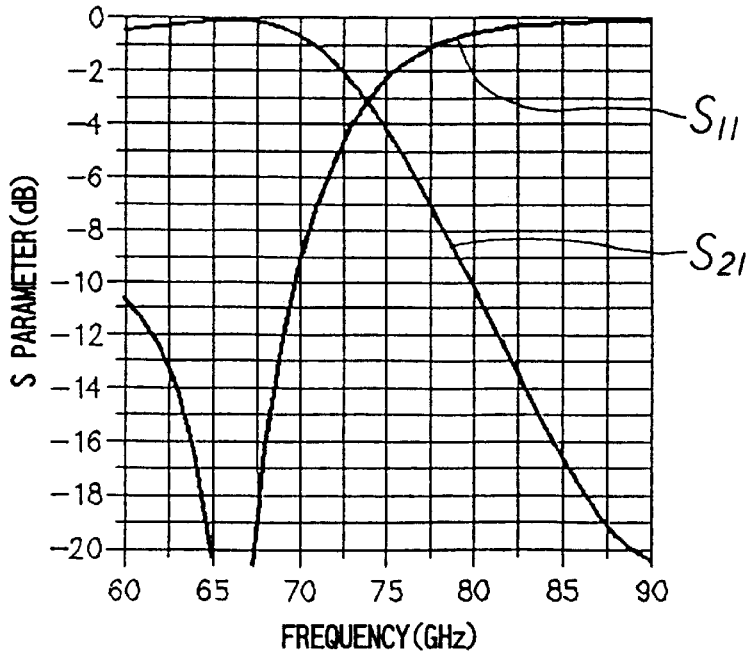
FIG. 6B is a diagram showing a frequency characteristic in transmission characteristics of the example of FIG. 6A.

FIGS. 6A and 6B show an example where the width e of the coupling window 7 is set to 0.2 mm while the thickness a, space (width) b and length w are equal to those of FIG. 5A. In this example, the best transmission of electromagnetic waves is obtained at a frequency of 66 $GH_z$, and the frequency band permitting transmission is somewhat wider than that in FIG. 5A.

Figure 7A:
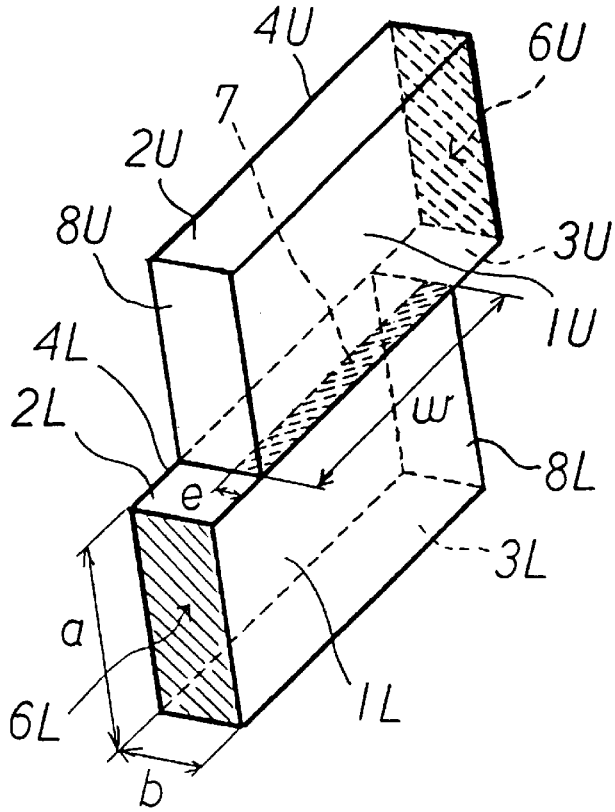
FIG. 7A is a perspective view showing a further example of the connection structure for dielectric waveguide lines according to the invention.
Figure 7B:
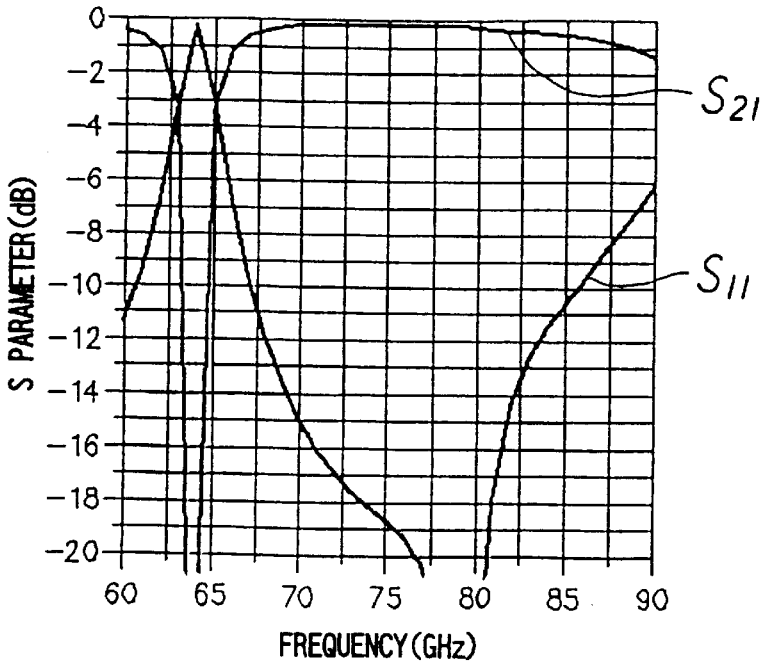
FIG. 7B is a diagram showing a frequency characteristic in transmission characteristics of the example of FIG. 7A.

FIGS. 7A and 7B show an example where the length w is increased to 2.4 mm while the thickness a, space (width) b, and width e are equal to those of FIG. 6A. In this example, it is indicated that electromagnetic waves within a wide frequency band of 70 $GH_z$ to 80 $GH_z$ can be transmitted.

In this way, it is confirmed that according to the connection structure for dielectric waveguide lines of the invention, by changing the profile and size of the coupling window, it is possible to change a frequency characteristic of an electromagnetic wave of a high-frequency signal transmitting through the connection portion to a desired value.

The invention is not limited to the above-described embodiments, but may be changed or modified within the scope of the invention. For example, electromagnetic waves in the lower dielectric waveguide line 6L and in the upper dielectric waveguide line 6U propagate in the same direction in the above embodiments, however, the electromagnetic waves may propagate in opposite directions by providing ends of the dielectric waveguide lines 6L and 6U on the same side of the connection portion. Moreover, the dielectric waveguide lines 6L and 6U may be formed so as to intersect at an arbitrary angle. In this case, by adapting the main conductor layers 2L, 3L (2U, 3U) to the H planes, it is possible to obtain a similar function to that of a Bethe-hole directional coupler in the conventional waveguide.

Furthermore, the profile of the coupling window 7 may be circular, polygonal and the like, or may be narrowed and elongated to have what is called a slot shape. Also, the coupling window 7 may be formed in plural numbers.

The section profile of the plurality of through conductors constituting the side-wall through conductor groups 4L, 4U may be oval, triangular, rectangular, polygonal, or plate-like besides circular as shown in FIG. 2.

Figure 8A:
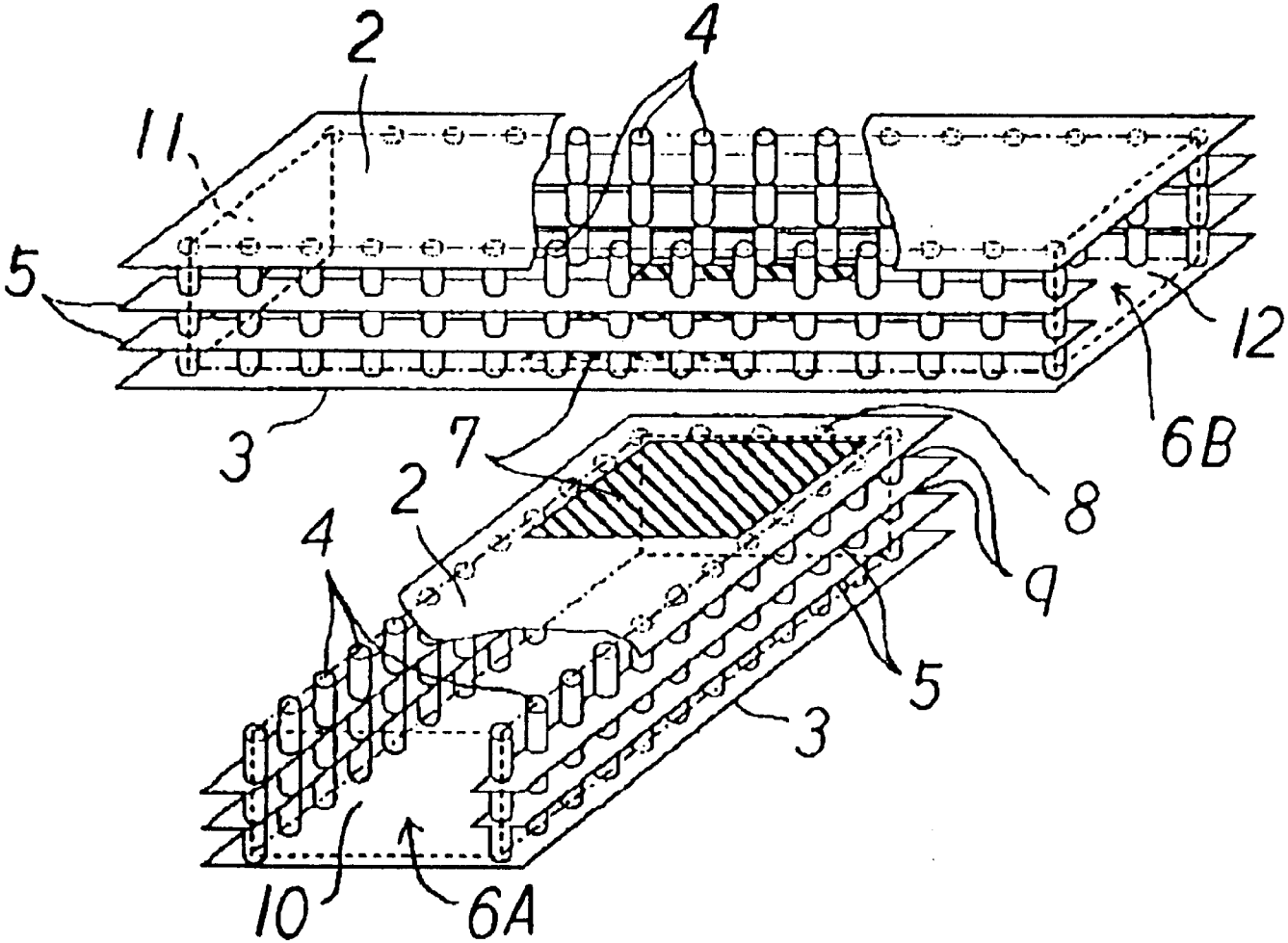
FIG. 8A is an exploded perspective view showing dielectric waveguide lines before connection in another embodiment of a connection structure for dielectric waveguide lines of the invention.
Figure 8B:
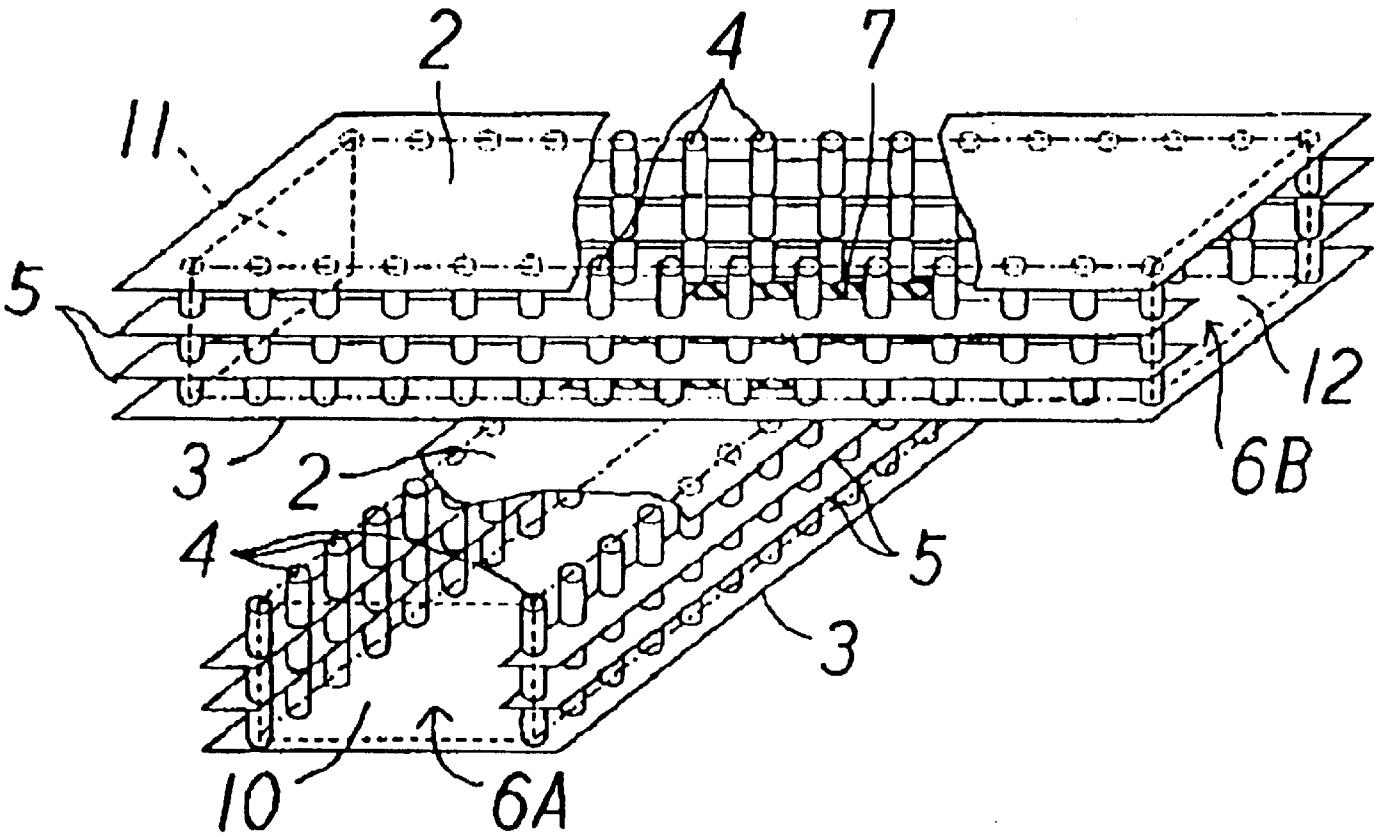
FIG. 8B is a perspective view showing the dielectric waveguide lines after connection.
Figure 8C:
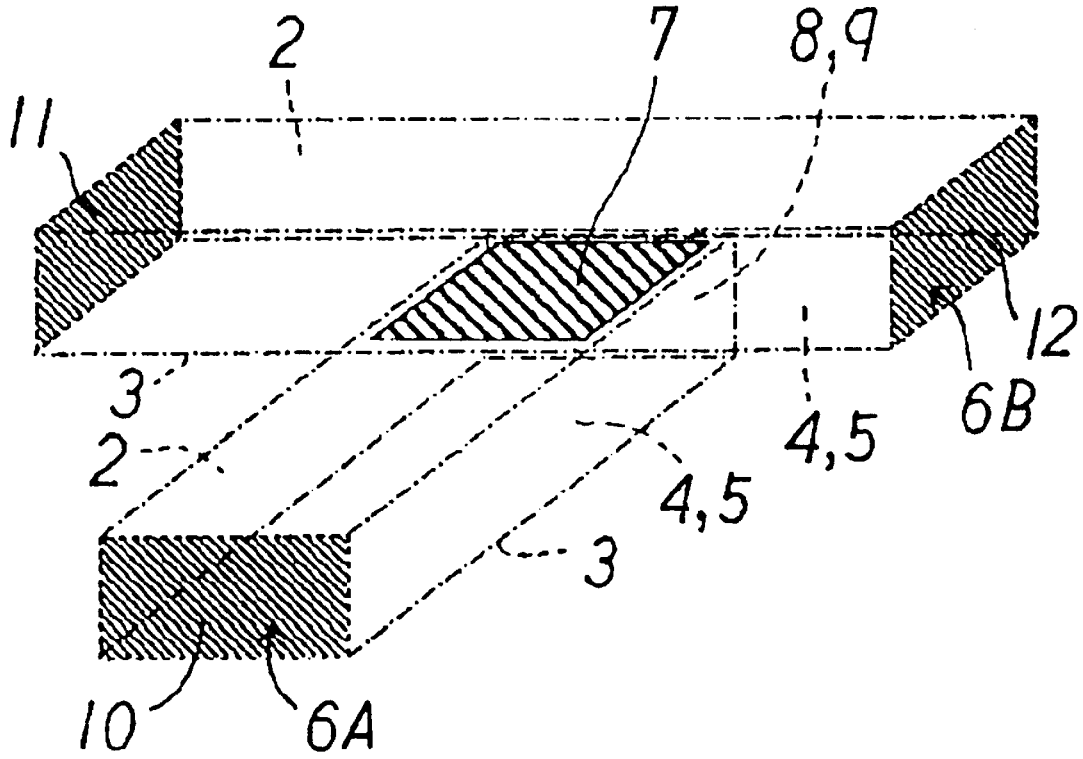
FIG. 8C is a perspective view showing the dielectric waveguide lines outlined for ease of understanding.

Next, another embodiment of the connection structure for dielectric waveguide lines according to the invention is shown in FIGS. 8A, 8B, and 8C.

In the connection structure of FIGS. 8A, 8B and 8C, one dielectric waveguide line is stacked on an end portion of the other dielectric waveguide line so that high-frequency signal transmission directions thereof intersect at right angels. FIG. 8A is an exploded perspective view showing dielectric waveguide lines before connected, FIG. 8B is a perspective view showing the dielectric waveguide lines after connected, and FIG. 8C is a perspective view showing the dielectric waveguide lines outlined for ease of understanding. In these drawings, the same elements are denoted by the same reference numerals in FIG. 1, and representation of the dielectric substrate is omitted. The main conductor layer 2 is shown in perspective with being partially cutaway.

In FIGS. 8A, 8B, and 8C reference numerals 2, 3 denote a pair of main conductor layers, reference numeral 4 denotes two rows of side-wall conductor groups, reference numeral 5 denotes a sub conductor layer, and reference numerals 6A, 6B denote dielectric waveguide lines. These two dielectric waveguide lines 6A, 6B are disposed so that high-frequency signal transmission directions thereof intersect at right angles and one of the main conductor layers 2, 3 of one dielectric waveguide line and one of the main conductor layers 2, 3 of the other dielectric waveguide line overlap each other. In this embodiment, the upper main conductor layer 2 of the dielectric waveguide line 6A and the lower main conductor layer 3 of the dielectric waveguide line 6B overlap each other. In the part where the main conductor layers 2, 3 overlap each other, both the main conductor layers 2, 3 are provided with a coupling window 7 which is a portion lacking conductors (diagonally shaded in the main conductor layers 2, 3).

Preferably, in the case where the main conductor layer 2 of the dielectric waveguide line 6A and the main conductor layer 3 of the dielectric waveguide line 6B are commonly formed in the overlap part, and the coupling window 7 is formed in this common main conductor layer, an excellent transmission characteristic of high-frequency signal is obtained at the connection portion.

Also, in this embodiment, one dielectric waveguide line 6B is connected to the end portion of the other dielectric waveguide line 6A, and the dielectric waveguide line 6A is provided with an end through conductor group 8 and end sub conductor layers 9 for forming an end surface. The end through conductor group 8 are formed at a distance not longer than the guide wavelength of high-frequency signal from the center of the coupling window in the transmission direction, so as to electrically connect the main conductor layers 2 and 3, the end through conductor group being arranged at repetition intervals less than one half of the signal wavelength in a direction orthogonal to the transmission direction of the dielectric waveguide line 6A. The end sub conductor layers 9 are disposed between the main conductor layers 2 and 3 so as to be parallel with the main conductor layers, and are electrically connected with the sub conductor layers 5 and the end through conductor group 8.

As described above, the two dielectric waveguide lines 6A, 6B are stacked one over the other so that the lines 6A and 6B intersect at right angles and one of the main conductor layers 2, 3 of one dielectric waveguide line and one of the main conductor layers 2, 3 of the other dielectric waveguide line overlap each other, and the coupling window 7 is provided in the part where the main conductor layers 2 and 3 overlap each other. As a result, the two dielectric waveguide lines 6A and 6B are electromagnetically coupled via the coupling window 7. Still more, in this embodiment, the dielectric waveguide lines constitute a T-shaped branch structure, so that high-frequency signals inputted from a port 10 of the dielectric waveguide line 6A are transmitted to the dielectric waveguide line 6B via the coupling window 7 while being branched in two directions with the same phase, and outputted from ports 11, 12, respectively.

Even if the dielectric waveguide line 6A is not provided with the end through conductor group 8 and the end sub conductor layers 9, it is possible to configure a cross-shaped branch structure of dielectric waveguide line if the dielectric waveguide line 6A and the dielectric waveguide line 6B are connected with each other at their midpoints. In this case, high-frequency signals inputted from the port 10 of the dielectric waveguide line 6A are transmitted while being divided into signals to be transmitted along the dielectric waveguide line 6A; signals which propagate to the dielectric waveguide line 6B via the coupling window 7 to be branched and transmitted in two directions with the same phase to the ports 11, 12. This constitute a branch structure of dielectric waveguide line which can branch a single line into three lines which intersect at right angles.

According to the connection structure for dielectric waveguide lines of the invention, characteristics will not restricted by the thickness of the dielectric substrate 1 as is the case of the conventional connection structure for dielectric waveguide lines in which coupling is accomplished by a feed pin. Furthermore, before laminating green sheets which will constitute the dielectric substrate 1, a pattern of the coupling window 7 can be formed in printing the part of the main conductor layers 2, 3 where the two dielectric waveguide lines 6A, 6B overlap. Therefore, the productivity becomes high, and the production costs are reduced.

Also, according to the connection structure for dielectric waveguide lines of the invention, the electromagnetic energy having propagated along the one dielectric waveguide line 6A is directly coupled to the electromagnetic energy of the other dielectric waveguide line 6B via the coupling window 7, and therefore, energy loss such as heat production or the like due to a resistance element will not occur, and a connection structure which shows little transmission loss and good transmission characteristic is realized.

In the connection structure for dielectric waveguide lines of the invention, when the coupling window 7 is formed, the position, profile and size thereof are complicatedly related to the frequency characteristics, coupling amount and reflection amount required for the connection structure. For this reason, in order to satisfy the desired frequency characteristic, calculations using the electromagnetic field analysis are repeatedly executed so as to determine the position, profile, size and the like of the coupling window 7 having the desired connection characteristic.

Further, in the connection structure for dielectric waveguide lines of the invention, when the end through conductor group 8 and the end sub conductor layers 9 are provided as in the case of the dielectric waveguide line 6B shown in FIG. 8, the positions thereof may be determined by an electromagnetic analysis in accordance with a required characteristic. Every position is possible as far as the required characteristic is satisfied, however, the most preferable position is within a distance not longer than the guide wavelength from the center of the coupling window 7. This is because a phase at the center of the coupling window 7 is adjusted by the position of the end surface and the phase is repeated every guide wavelength $\lambda g$.

Furthermore, the end of the dielectric waveguide line 6A constituted of the end through conductor group 8 and the end sub conductor layers 9 is formed in accordance with its purpose, and is not necessarily formed as described above. Also, such end may be provided in the dielectric waveguide line 6B as necessary. For example, in the case where the dielectric waveguide line 6B is also provided with the end through conductor group 8 and the end sub conductor layers 9 on the side of the port 11 so as to form an end, while the dielectric waveguide line 6A is provided with the end surface as shown in FIGS. 8A, 8B, and 8C an electromagnetic wave inputted from the port 10 of the dielectric waveguide line 6A is transmitted to the dielectric waveguide line 6B via the coupling window 7, and then outputted from the port 12 of the dielectric waveguide line 6B. That is, in this case, a connection structure in which the lower dielectric waveguide line 6A and the upper dielectric waveguide line 6B are connected in a shape of L.

Figure 9A:
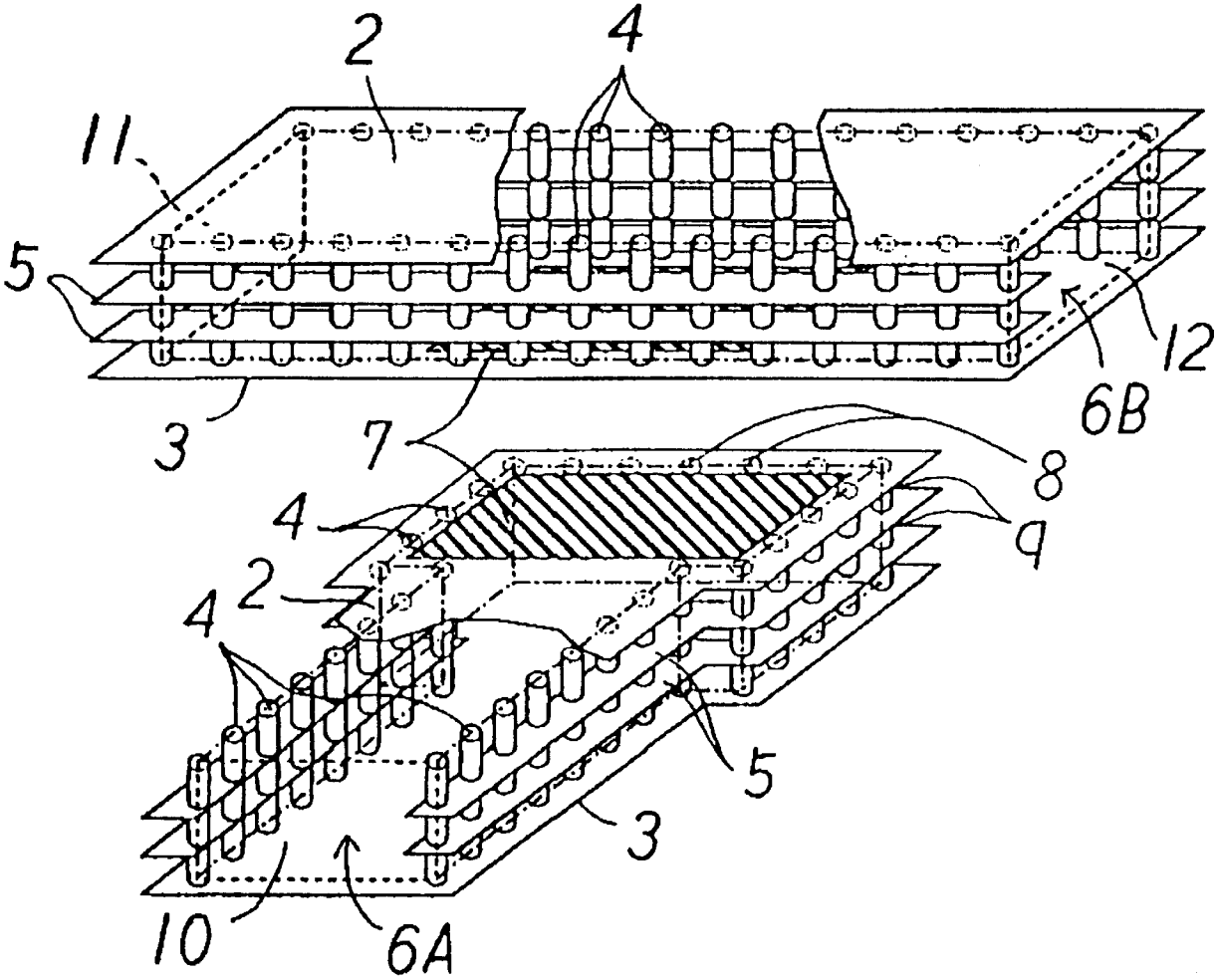
FIG. 9A is an exploded perspective view showing dielectric waveguide lines before connection in still another embodiment of a connection structure for dielectric waveguide lines of the invention.
Figure 9B:
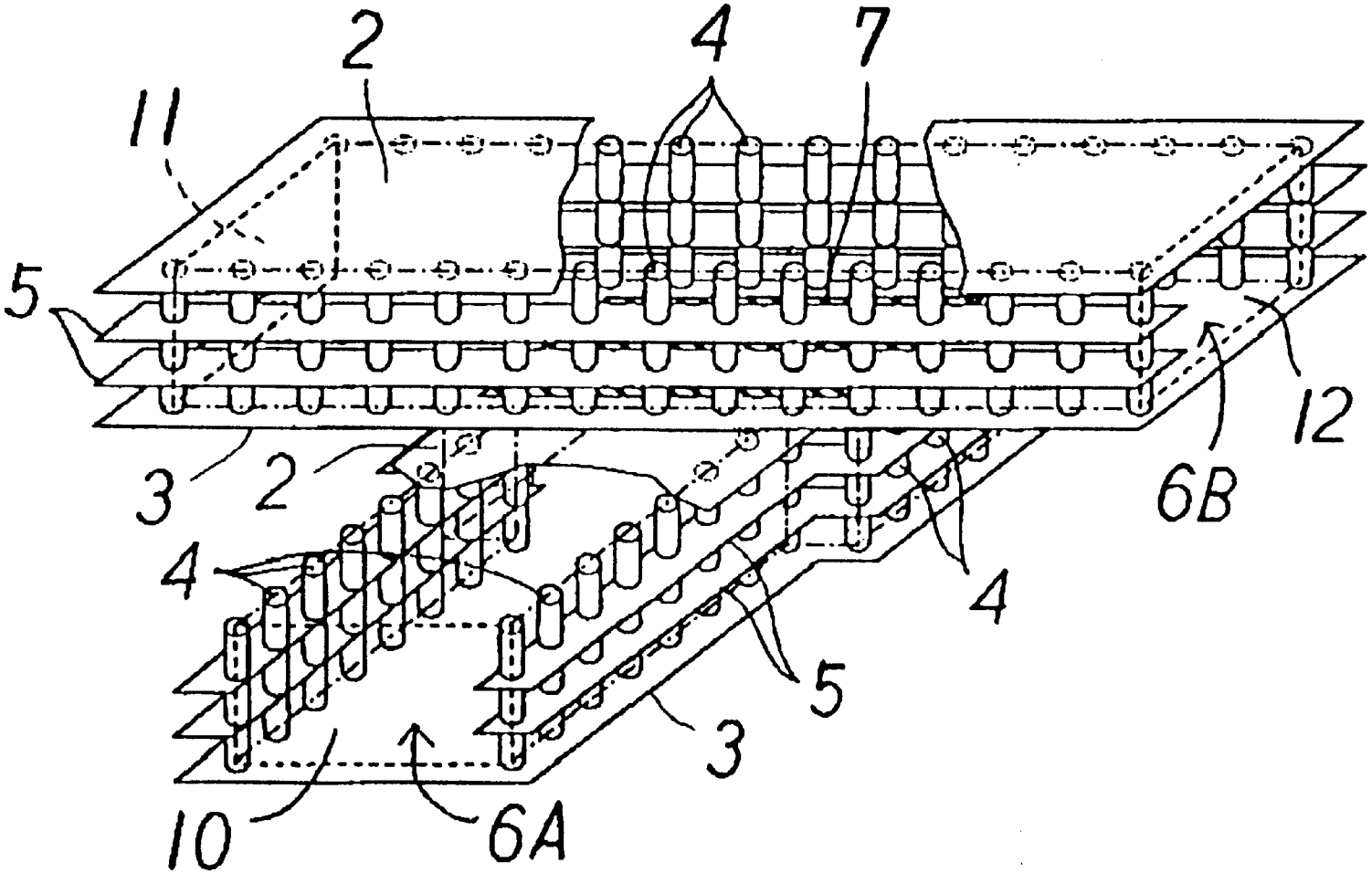
FIG. 9B is a perspective view showing the dielectric waveguide lines after connection.
Figure 9C:
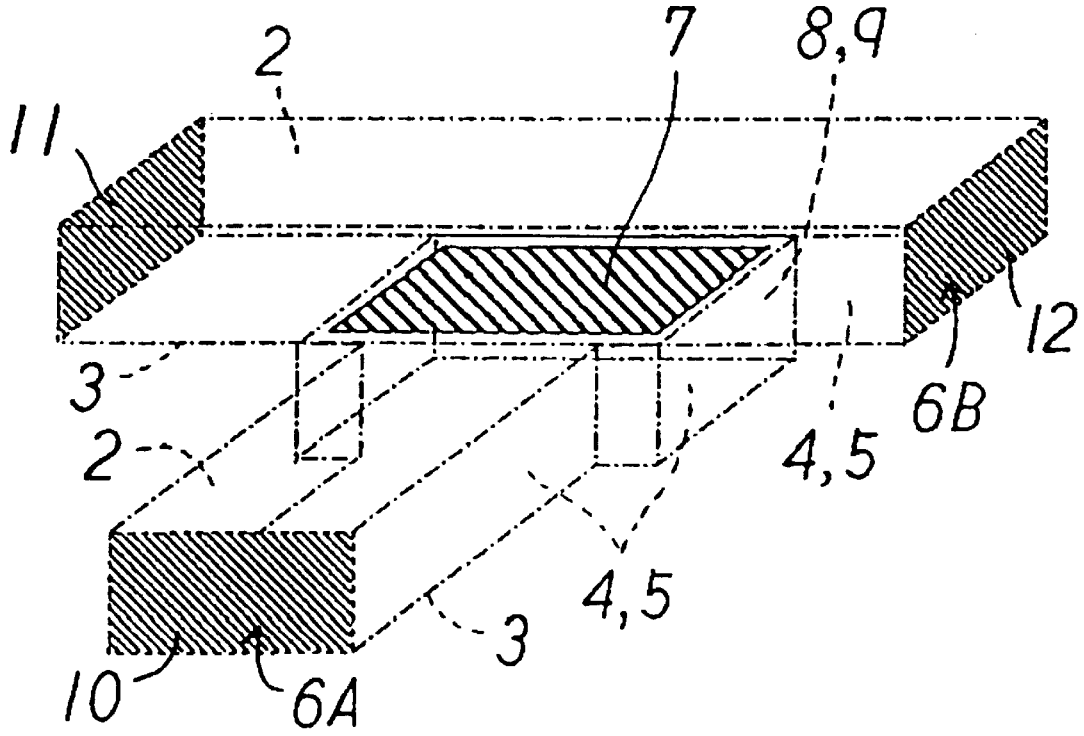
FIG. 9C is a perspective view showing the dielectric waveguide lines outlined for ease of understanding.

Next, still another embodiment of the connection structure for dielectric waveguide lines according to the invention is shown in FIGS. 9A, 9B, and 9C.

FIGS. 9A, 9B and 9C show a connection structure for dielectric waveguide lines similar to the embodiment shown in FIGS. 8A, 8B and 8C however, the width of the lower dielectric waveguide line and the width of the coupling window are increased at the connecting portion. FIG. 9A is an exploded perspective view showing dielectric waveguide lines before connected, FIG. 9B is a perspective view showing the dielectric waveguide lines after connected, and FIG. 9C is a perspective view showing the dielectric waveguide lines outlined for ease of understanding. Also in these drawings, the same elements are denoted by the same reference numerals as FIGS. 1 and 8A, 8B, and 8C. The main conductor layer 2 is shown in perspective with being partially cutaway.

In FIGS. 9A, 9B, and 9C, reference numerals 2, 3 denote a pair of main conductor layers, reference numeral 4 denotes two rows of side-wall through conductor groups, reference numeral 5 denotes a sub conductor layer, and reference numerals 6A, 6B denote dielectric waveguide lines. These two dielectric waveguide lines 6A, 6B are disposed so that high-frequency signal transmission directions thereof intersect at right angles and one of the main conductor layers 2, 3 of one dielectric waveguide line and one of the main conductor layers 2, 3 of the other dielectric waveguide line overlap each other. In this embodiment, the upper main conductor layer 2 of the dielectric waveguide line 6A and the lower main conductor layer 3 of the dielectric waveguide line 6B overlap each other. Reference numeral 8 denotes an end through conductor group, reference numeral 9 denotes an end sub conductor layer, and reference numerals 10 to 12 denote ports.

In this embodiment, the width of the two rows of the side-wall through conductor groups 4 of the lower dielectric waveguide lines 6A is increased as compared to the predetermined width ("b" shown in FIG. 1) in the part where the dielectric waveguide lines 6A and 6B overlap each other. And in the overlap part, both the main conductor layers 2, 3 are provided with a coupling window 7 which is a portion lacking conductors (diagonally shaded in the main conductor layers 2, 3). Also, the width of the coupling window 7, that is an opening dimension in the width direction of the side-wall through conductor groups 4 of the dielectric waveguide lines 6A in this embodiment is increased so as to coincide with the width of the two rows of side-wall through conductor groups 4 of the dielectric waveguide line 6A.

As a result, the two dielectric waveguide lines 6A, 6B are connected to each other while being electromagnetically coupled via the coupling window 7. By approximately changing the width of the connection portion of the dielectric waveguide lines 6A and 6B, or the width in the width direction of the two rows of side-wall through conductor groups 4 of the dielectric waveguide line 6A in this embodiment, and the size of the coupling window 7, it is possible to reduce the reflection of high-frequency signal at the connection portion of the dielectric waveguide lines 6A and 6B and to obtain a connection structure of low losses.

The configuration in which the width of the two rows of side-wall through conductor groups 4 is made wider than the predetermined width b in the overlap part of the dielectric waveguide lines 6A and 6B, may be applicable not only to the lower dielectric waveguide line 6A but also to the upper dielectric waveguide line 6B, and may be applicable to both of the dielectric waveguide lines 6A, 6B. When the width of the two rows of side-wall through conductor groups 4 is made wider than the predetermined width b, the widened width may be set in the range from the predetermined width b to twice the predetermined width b.

Figure 10A:
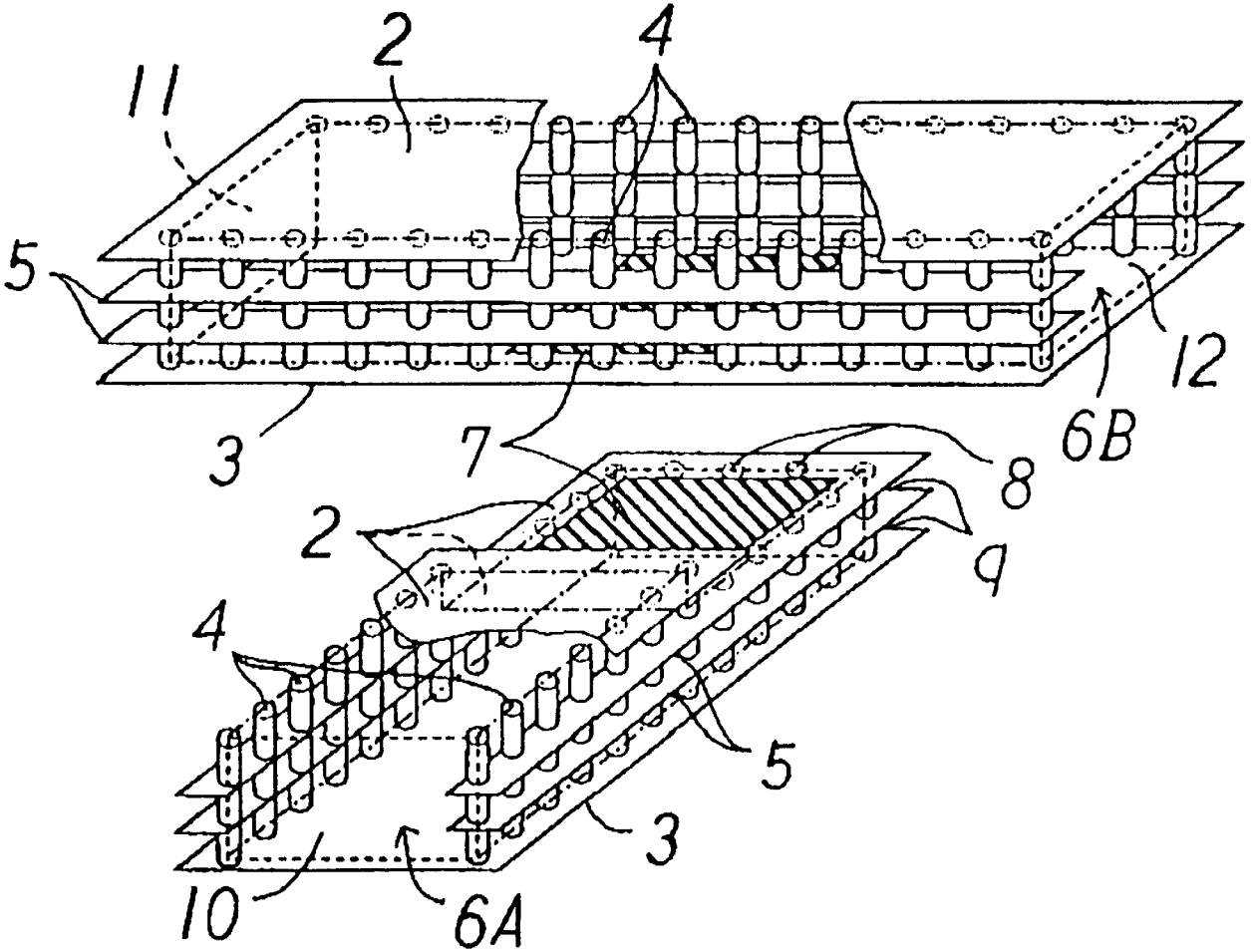
FIG. 10A is an exploded perspective view showing dielectric waveguide lines before connection in yet still another embodiment of a connection structure for dielectric waveguide lines of the invention.
Figure 10B:
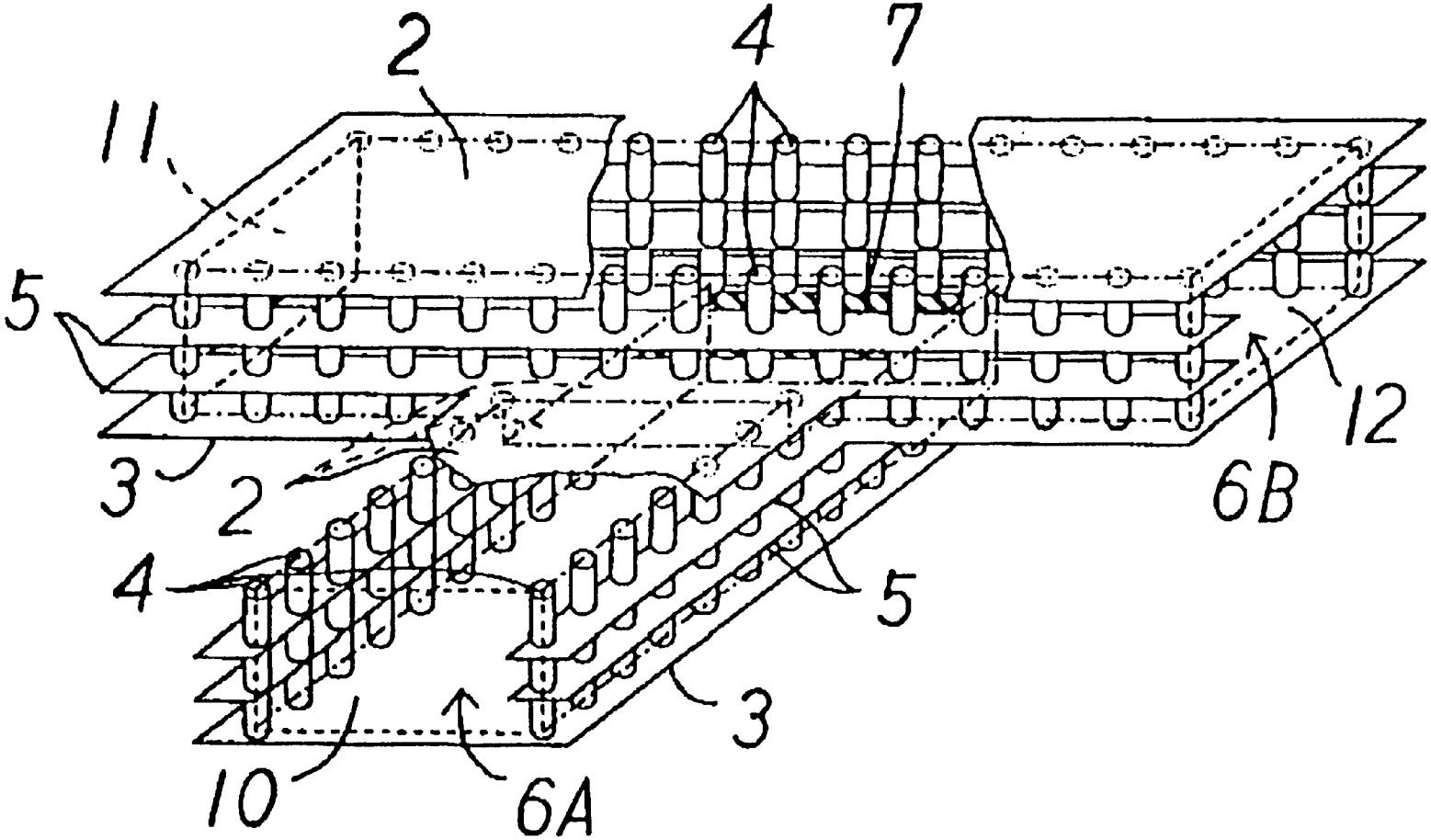
FIG. 10B is a perspective view showing the dielectric waveguide lines after connection.
Figure 10C:
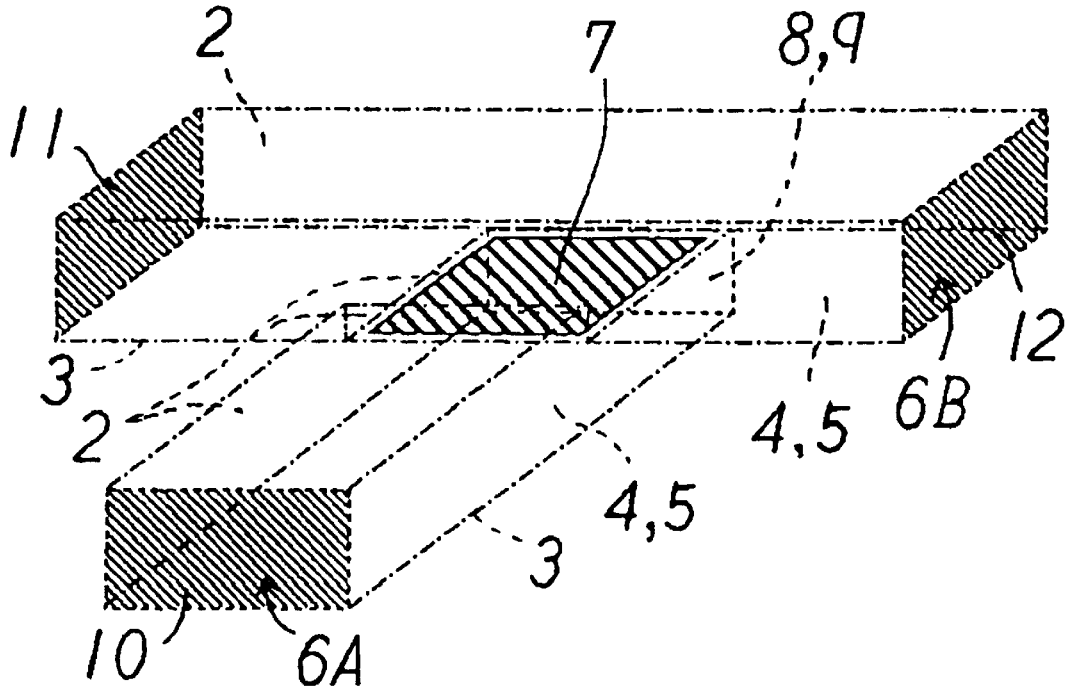
FIG. 10C is a perspective view showing the dielectric waveguide lines outlined for ease of understanding.

Next, yet still another embodiment of the connection structure for dielectric waveguide lines according to the invention is shown in FIGS. 10A, 10B, and 10C.

FIGS. 10A, 10B, and 10C show a connection structure for dielectric waveguide lines similar to the embodiment shown in FIGS. 8A, 8B, and 8C, however, the thickness of the lower dielectric waveguide line at the connection portion is made thinner. FIG. 10A is an exploded perspective view showing dielectric waveguide lines before connected, FIG. 10B is a perspective view showing the dielectric waveguide lines after connected, and FIG. 10C is a perspective view showing the dielectric waveguide lines outlined for ease of understanding. In these drawings, the same elements are denoted by the same reference numerals as FIGS. 1, 8A, 8B, 8C, 9A, 9B, and 9C and representation of the dielectric substrate is omitted. The main conductor layer 2 is shown in perspective with being partially cutaway.

In FIGS. 10A, 10B, and 10C, reference numerals 2, 3 denote a pair of main conductor layers, reference numeral 4 denotes two rows of side-wall through conductor groups, reference numeral 5 denotes a sub conductor layer, and reference numerals 6A, 6B denote dielectric waveguide lines. These two dielectric waveguide lines 6A, 6B are disposed so that high-frequency signal transmission directions thereof intersect at right angles and one of the main conductor layers 2, 3 of one dielectric waveguide line and one of the main conductor layers 2, 3 of the other dielectric waveguide line overlap each other. In this embodiment, the upper main conductor layer 2 of the dielectric waveguide line 6A and the lower main conductor layer 3 of the dielectric waveguide line 6B overlap each other. Reference numeral 7 denotes a coupling window, reference numeral 8 denotes an end through conductor group, reference numeral 9 denotes an end sub conductor layer, and reference numerals 10 to 12 denote ports.

In this embodiment, the main conductor layer 2 of the lower dielectric waveguide line 6A is formed to have a step such that the main conductor layer 2 gets closer to the main conductor layer 3 in the overlap part of the dielectric waveguide lines 6A, 6B. As a result, the thickness of the dielectric waveguide line 6A is made thinner, that is the distance between the pair of main conductor layers 2, 3 (distance between the main conductor layer 3 of the dielectric waveguide line 6A and the main conductor layer 3 of the dielectric waveguide line 6B, in the case where the main conductor layer 2 of the dielectric waveguide line 6A and the main conductor layer 3 of the dielectric waveguide line 6B are commonly formed) is made smaller than that in the remaining part ("a" shown in FIG. 1).

Connection between the steps of the main conductor layer 2 having different heights (or between the main conductor layer 2 of the dielectric waveguide line 6A and the main conductor layer 2 of the dielectric waveguide line 6B) may be achieved electrically by means of a conductor layer which is formed in the height direction as shown in FIGS. 10A, 10B, and 10C or by means of main conductor layer connecting through conductor groups which will be described later.

As a result, these two dielectric waveguide lines 6A and 6B are connected to each other while being electromagnetically coupled via the coupling window 7. In this way, the thickness in the vicinity of the connection portion of the dielectric waveguide lines is appropriately changed, or in particular, the distance between the pair of main conductor layers 2, 3 is made smaller than that of the remaining part by forming the main conductor layer 2 of the dielectric waveguide line 6A to have a height difference in this embodiment. As a result of this, it is possible to reduce the reflection of high-frequency signal at the connection portion of the dielectric waveguide lines 6A, 6B and to obtain a connection structure of low losses.

Figure 11A:
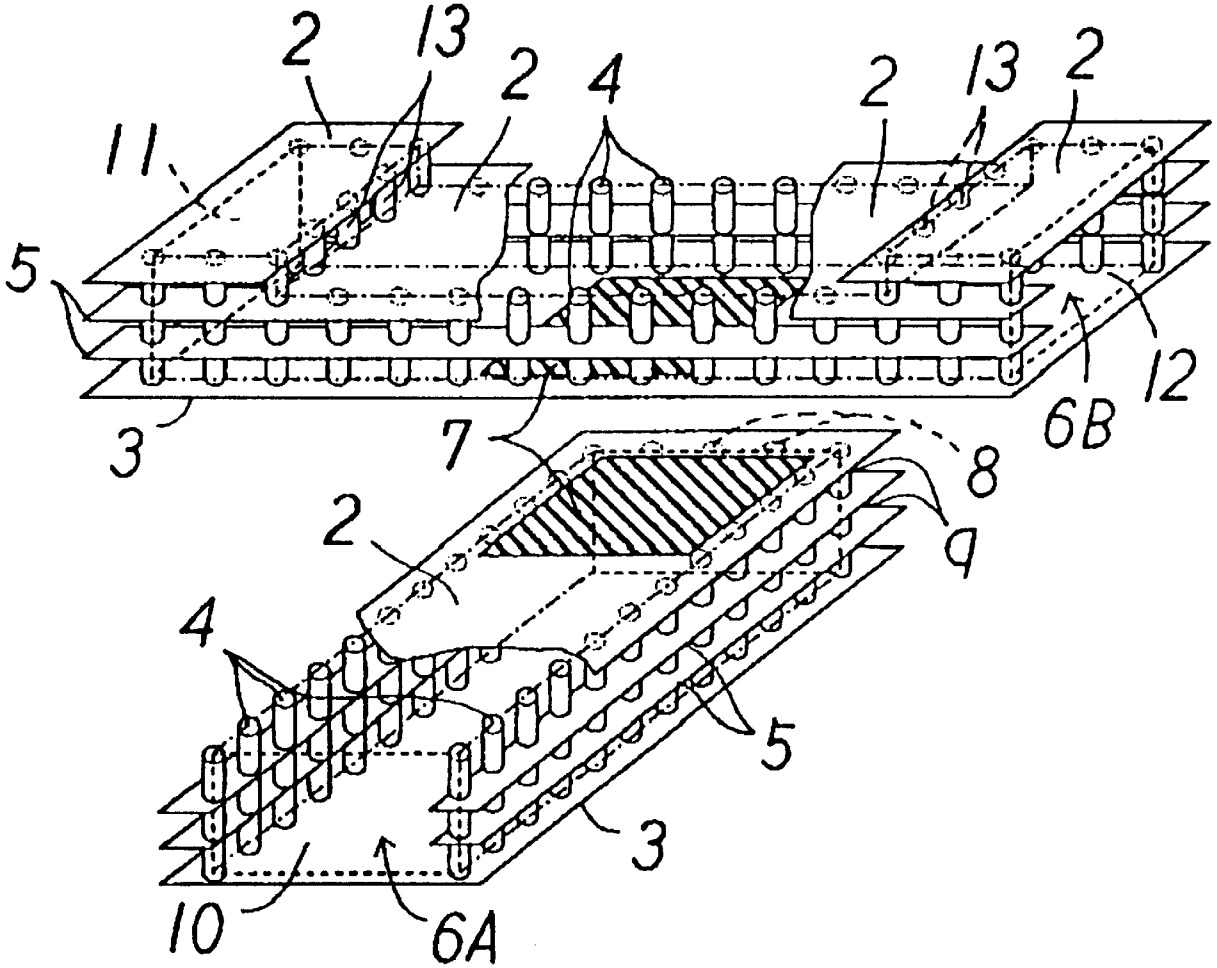
FIG. 11A is an exploded perspective view showing dielectric waveguide lines before connection in a further embodiment of a connection structure for dielectric waveguide lines of the invention.
Figure 11B:
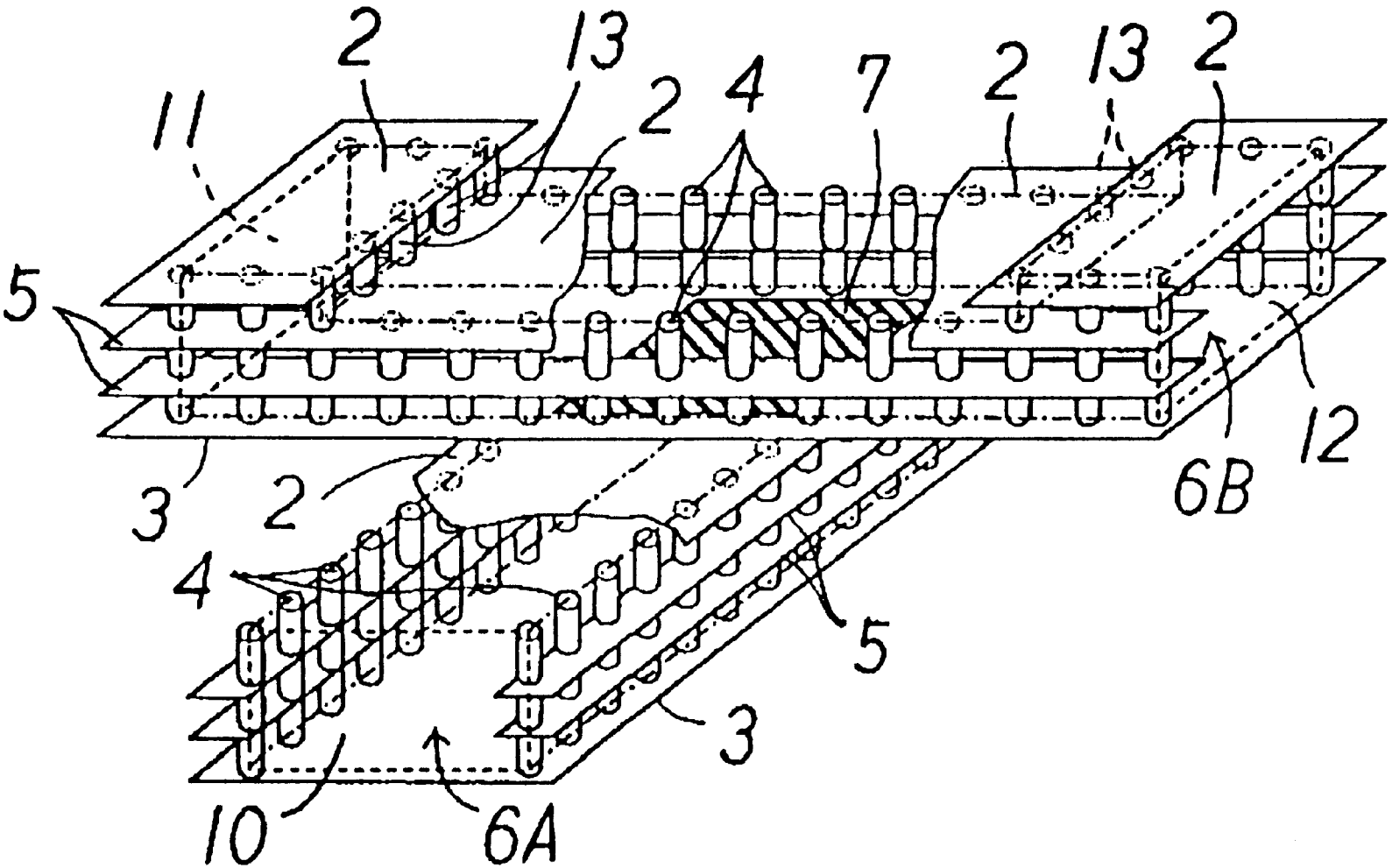
FIG. 11B is a perspective view showing the dielectric waveguide lines after connection.
Figure 11C:
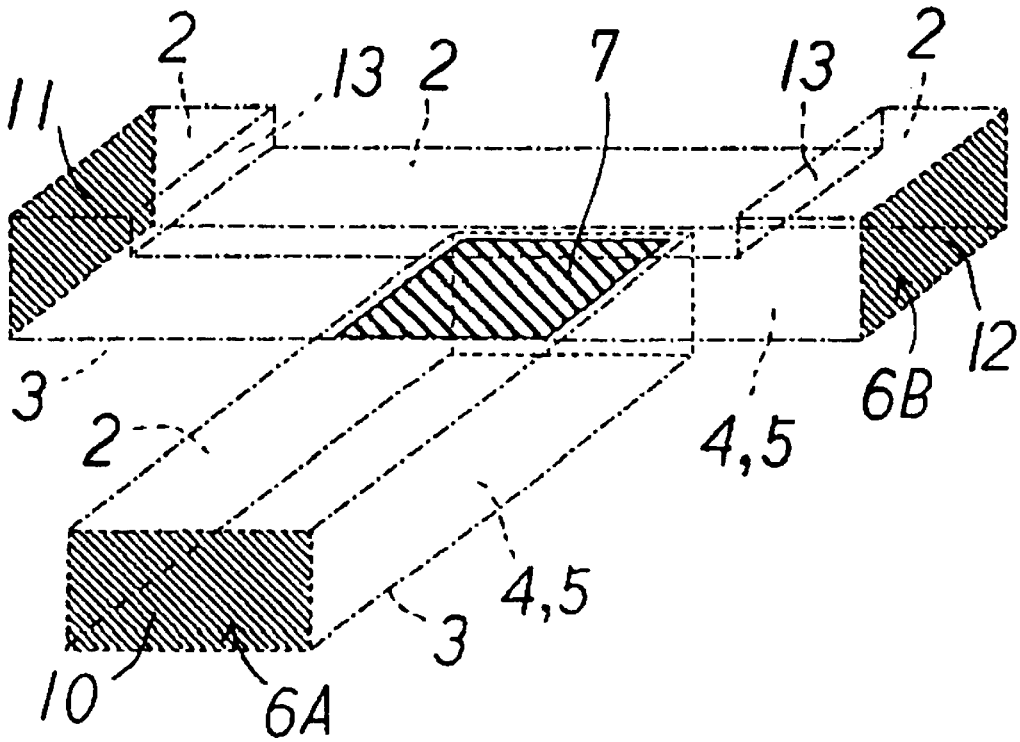
FIG. 11C is a perspective view showing the dielectric waveguide lines outlined for ease of understanding.

Next, a further embodiment of the connection structure for dielectric waveguide lines according to the invention is shown FIGS. 11A, 11B, and 11C.

FIGS. 11A, 11B, and 11C show a connection structure for dielectric waveguide lines similar to the embodiment shown in FIGS. 8A, 8B, and 8C however, the thickness of the upper dielectric waveguide line at the connection portion is made thinner. FIG. 11A is an exploded perspective view showing dielectric waveguide lines before connected, FIG. 11B is a perspective view showing dielectric waveguide lines after connected, and FIG. 11C is a perspective view showing dielectric waveguide lines outlined for ease of understanding. In these drawings, the same elements are denoted by the same reference numerals as FIGS. 1, 8A, 8B, 8C, 9A, 9B, 9C, 10A, 10B, and 10C and representation of the dielectric substrate is omitted. The main conductor layer 2 is shown in perspective with the conductor layer 2 partially cutaway.

In FIGS. 11A, 11B, and 11C, reference numerals 2, 3 denote a pair of main conductor layers, reference numeral 4 denotes two rows of side-wall through conductor groups, reference numeral 5 denotes a sub conductor layer, and reference numerals 6A, 6B denote dielectric waveguide lines. These two dielectric waveguide lines 6A, 6B are disposed so that high-frequency signal transmission directions thereof intersect at right angles and one of the main conductor layers 2, 3 of one dielectric waveguide line and one of the main conductor layers 2, 3 of the other dielectric waveguide line overlap each other. In this embodiment, the upper main conductor layer 2 of the dielectric waveguide line 6A and the lower main conductor layer 3 of the dielectric waveguide line 6B overlap each other. Reference numeral 7 denotes a coupling window, reference numeral 8 denotes an end through conductor group, reference numeral 9 denotes an end sub conductor layer, and reference numerals 10 to 12 denote ports.

In this embodiment, the main conductor layer 2 of the upper dielectric waveguide line 6B is formed to have a step such that the main conductor layer 2 gets closer to the main conductor layer 3 in the overlap part of the dielectric waveguide lines 6A, 6B. As a result, the thickness of the dielectric waveguide line 6B is made thinner, that is the distance between the pair of main conductor layers 2, 3 is made smaller than that of the remaining part ("a" shown in FIG. 1).

The main conductor layer 2 is formed in a plane different from that of the remaining part of the main conductor layer 2, particularly in the plane of one of the sub conductor layers 5, at the connection portion of the dielectric waveguide lines 6A, 6B. And the main conductor layer 2 at the connection portion and the main conductor layer 2 at the rest part are electrically connected to each other via main conductor layer connecting through conductor groups 13. These main conductor layer connecting through conductor groups 13, likewise the side-wall through conductor groups 4 and the end through conductor group 8, are formed in a direction orthogonal to the transmission direction of the dielectric waveguide line 6B at repetition intervals less than one half of the signal wavelength such that the main conductor layers 2 having different heights may be electrically connected to each other.

In place of the main conductor layer connecting through conductor groups 13, the main conductor layers 2 having different heights may be connected to each other via a main conductor formed in the height direction.

As a result of this, the two dielectric waveguide lines 6A, 6B are connected to each other while being electromagnetically coupled via the coupling window 7. In this way, by approximately changing the thickness in the vicinity of the connection portion of the dielectric waveguide lines, or particularly in this embodiment, by forming the main conductor 2 of the dielectric waveguide line 6B so as to have a height difference, to thereby make the distance between the pair of main conductor layers 2 and 3 smaller than the other portions, reflection of high-frequency signal at the connection portion of the dielectric waveguide lines 6A, 6B is reduced and a connection structure of low losses is obtained.

As described above, the configuration in which a distance between the pair of main conductor layers 2, 3 is made smaller than the remaining part at the overlap part of the dielectric waveguide lines 6A, 6B may be applied either one or both of the upper dielectric waveguide line 6A and the lower dielectric waveguide line 6B. Also, the distance between the pair of main conductor layers 2 and 3 may be changed by changing either one or approximately both of the height of the main conductor layer 3 of the lower dielectric waveguide line 6A and the height of the main conductor layer 3 of the upper dielectric waveguide line 6B.

When the distance between the pair of main conductor layers 2 and 3 is made smaller than that of the remaining part at the connection portion, the reduced distance may be set in the range from one half the predetermined thickness a to the predetermined thickness a.

In a concrete example, with respect to the connection structure for dielectric waveguide lines of the invention having the configuration shown in FIGS. 8, frequency characteristics of level and phase of S parameters were calculated as transmission characteristics of a line including a T-shaped branch according to the finite element method. The frequency characteristics of S parameters were calculated while, as the materials of the main conductor layers 2, 3 and the through conductors, pure copper having a conductivity of $5.8\times10^7$ (1/Ωm) was used, and, as the dielectric substrate 1, a glass-ceramics sintered body was used which has a relative dielectric constant of 5 and a dielectric loss tangent of 0.001 and which was produced by firing 75 wt. % of borosilicate glass and 25 wt. % of alumina, and the thickness of the dielectric substrate 1 was set to be a=0.62 mm, the diameter of the through conductors to be 0.1 mm, the repetition intervals of the side-wall through conductor groups 4 to be c=0.25 mm, the predetermined width of the side-wall through conductor groups 4 to be b=1.2 mm, and the length of the line to be 2.25 mm.

The sub conductor layers 5 were disposed at the positions of 0.154 mm, 0.308 mm and 0.462 mm from the main conductor layer 3 so as to form a four layer structure, and the coupling window 7 was formed into a square of 1.2 mm×1.2 mm.

The end through conductor group 8 of the dielectric waveguide line 6A were formed so as to be extended from the side-wall through conductor groups 4 of the other dielectric waveguide line 6B. The diameter and the repetition intervals of the through conductors were similar to those of the side-wall through conductor groups 4. And the end sub conductor layers 9 were disposed at the same positions with the sub conductor layers 5.

Figure 12A:
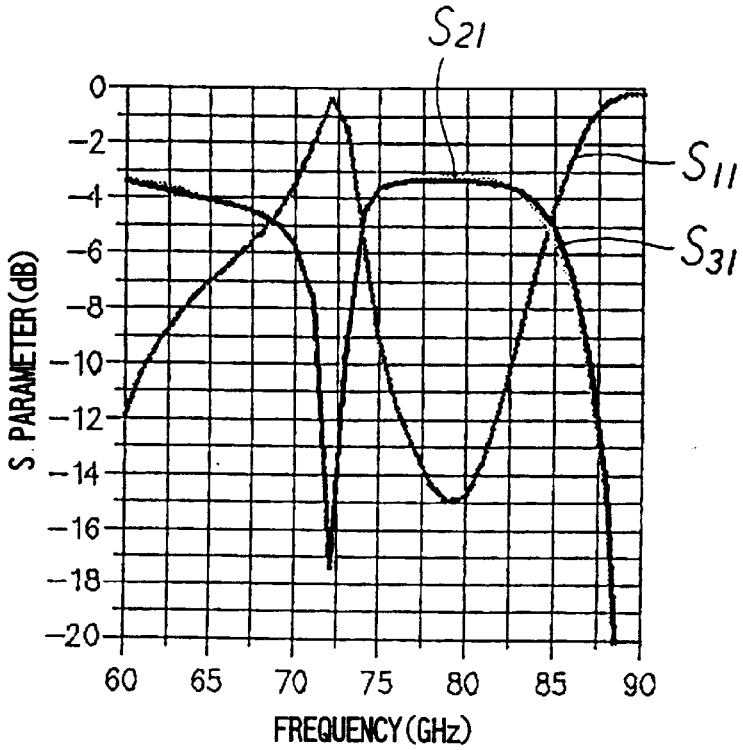
FIG. 12A is a diagram showing frequency characteristics of the level of S parameters in a connection structure for dielectric waveguide lines of the invention.
Figure 12B:
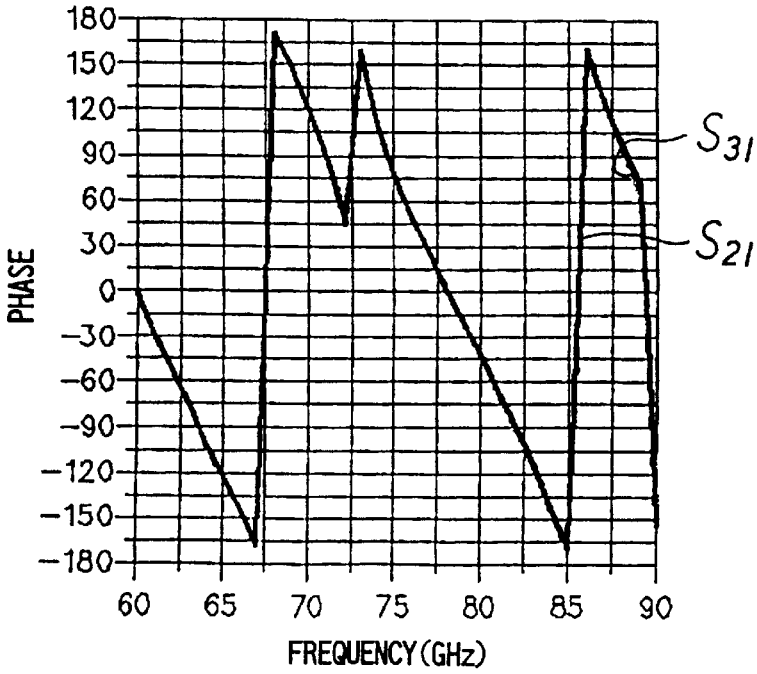
FIG. 12B is a diagram showing frequency characteristics of the phase of the S parameters.

The results are shown in a graph of FIG. 12A for the frequency characteristics of the level of S parameters, and in a graph of FIG. 12B for the frequency characteristics of the phase of S parameters, respectively. In FIG. 12A, the abscissa indicates the frequency (GHz) and the ordinate indicates the values of level (dB) of $S_{11}$, $S_{21}$ and $S_{31}$ of S parameters. The characteristic curves in the figure show the frequency characteristics of the respective S parameters. In FIG. 12B, the abscissa indicates the frequency (GHz) and the ordinate indicates the values of phase (degrees) of $S_{21}$ and $S_{31}$ of S parameters.

Regarding the connection structure for dielectric waveguide lines having the configuration shown in FIGS. 8A, 8B, and 8C $S_{11}$ indicates a ratio of electric power which is reflected and returned to the port 10 to the electric power inputted from the port 10, $S_{21}$ indicates the ratio of electric power which is outputted from the port 11 to the electric power inputted from the port 10, and $S_{31}$ indicates the ratio of electric power which is outputted from the port 12 to the electric power inputted from the port 10, respectively.

From the result of FIG. 12A, it can be seen that $S_{21}$ and $S_{31}$ are almost identical and that the high-frequency signal is satisfactorily transmitted through the connection portion. The ratio between $S_{21}$ and $S_{31}$ is almost constant within the frequency range of the calculations, which is 1:1. Further, the phases of the branched lines are the same. $S_{11}$ has its peak of about −15 dB in the vicinity of the design center frequency of 77 GHz, which shows that the reflection is very small.

On the other hand, it can be seen from the result of FIG. 12B that the characteristic curves expressing the phases of $S_{21}$ and $S_{31}$ are almost identical, indicating that $S_{21}$ and $S_{31}$ have the same phase.

Next, with respect to the connection structure for dielectric waveguide lines of the invention having the configuration of FIGS. 11A, 11B, and 11C, frequency characteristics of the level and phase of S parameters were calculated as a transmission characteristic of a line including a T-shaped branch according to the finite element method. The frequency characteristics of S parameters were calculated while the same materials as described above were used, and the thickness of the dielectric substrate 1 was set to be a=0.62 mm, the diameter of the through conductors to be 0.1 mm, the repetition intervals of the side-wall through conductor groups 4 to be c=0.25 mm, the predetermined width of the side-wall through conductor groups 4 to be b=1.2 mm, the distance between the pair of main conductor layers 2 and 3 of the dielectric waveguide line 6B at the connection portion (thickness of the dielectric waveguide line 6B) to be 0.15 mm, and steps of the main conductor layer 2 were connected via through conductors having the same diameter and repetition intervals as the side-wall through conductor groups 4. The length of the line was set to be 2.25 mm.

The end through conductor group 8 and the end sub conductor layers 9 were formed in the same manner as described above, and the coupling window 7 was formed into a rectanble of 1.5 mm×1.2 mm.

Figure 13A:
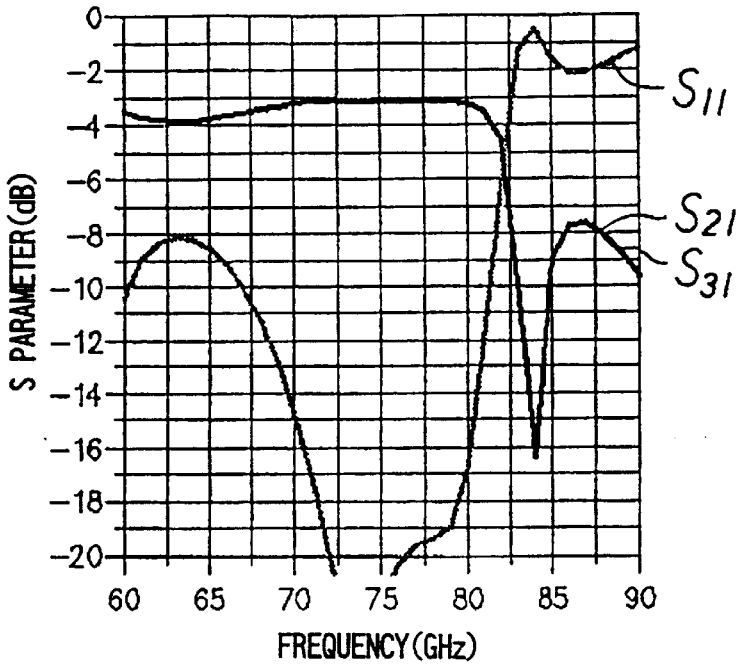
FIG. 13A is a diagram showing frequency characteristics of the level of S parameters in a connection structure for dielectric waveguide lines of the invention.
Figure 13B:
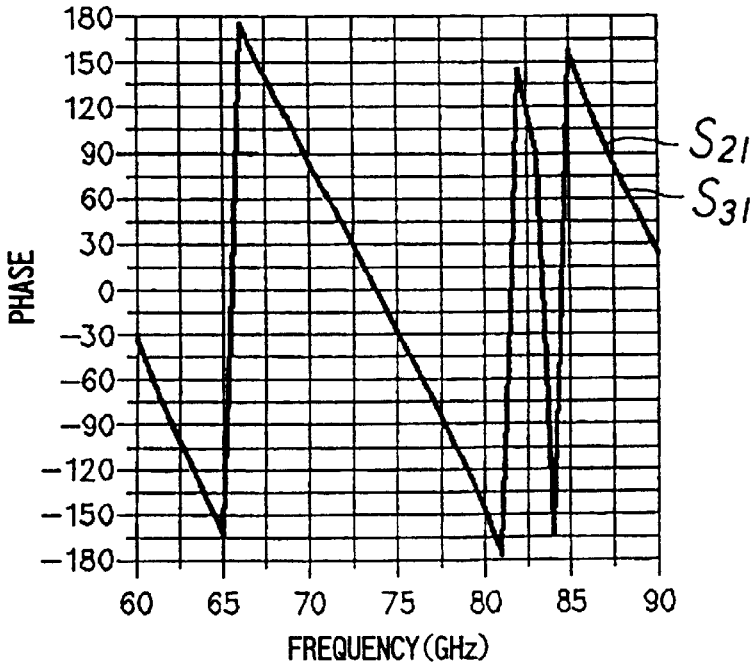
FIG. 13B is a diagram showing frequency characteristics of the phase of the S parameters.

The results are shown in a graph of FIG. 13A for the frequency characteristics of the level of S parameters, and in a graph of FIG. 13B for the frequency characteristics of the phase of S parameters, respectively, in the same manners as FIG. 12A and FIG. 12B.

It can be seen from the result of FIG. 13A that $S_{21}$ and $S_{31}$ are almost identical, and high-frequency signals of a wider band can preferably transmit the connection portion compared to case of the above concrete example. The ratio between $S_{21}$ and $S_{31}$ is almost constant in the frequency range on which calculations were executed, and is 1:1. The phases of the branched lines are the same. Regarding $S_{11}$, reflection is further reduced due to the provision of the matching portion, and the level is as low as −19.5 dB at the frequency of 77 GHz. In this way, the thickness of the dielectric waveguide line at the connection portion is made thinner, and the matching portion with respect to the transmission of a high-frequency signal is provided, so that $S_{11}$ becomes smaller compared to the above concrete example, and $S_{21}$ and $S_{31}$ are almost constant in the range of 71 GHz and 79 GHz.

Also, it can be seen from the result of FIG. 13B that the phases of $S_{21}$ and $S_{31}$ are identical.

In the same manner as the preceding concrete example, frequency characteristics of the level and phase of S parameters were calculated with respect to the connection structure for dielectric waveguide lines of the invention having the configuration of FIGS. 9A, 9B, and 9C in which the width of the lower dielectric waveguide line 6A at the connection portion and the width of the coupling window 7 were widened. The reflection of high-frequency electric power, or the peak of $S_{11}$ was smaller compared to the preceding concrete example, and thus it was confirmed that the reflection is further reduced by providing the matching portion.

In the same manner as the preceding concrete example, frequency characteristics of the level and phase of S parameters were calculated with respect to the connection structure for dielectric waveguide lines of the invention having the configuration of FIGS. 10A, 10B, and 10C in which the thickness of the lower dielectric waveguide line 6A at the connection portion was made thinner. The transmission band of high-frequency signal became wider compared to the preceding concrete example, and an excellent connection property was confirmed.

From the above results, it was confirmed that according to the connection structure for dielectric waveguide lines of the invention, the dielectric waveguide lines which are stacked one over the other so as to be orthogonal to each other within the dielectric substrate, can be readily connected with each other while achieving low transmission losses and excellent transmission characteristics. It was also confirmed that by crossing the two dielectric waveguide lines, it is possible to connect and branch the lines in a T shape with good transmission characteristics.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A connection structure for dielectric waveguide lines for transmitting high-frequency signals, comprising:

two dielectric waveguide lines stacked one over the other so that transmission directions of high frequency signals therein are parallel to each other, each of said lines comprising:

a dielectric substrate;

a pair of main conductor layers, the dielectric substrate being sandwiched between the pair of main conductor layers;

two rows of side-wall through conductor groups disposed so as to electrically connect the main conductor layers at intervals less than one half of a signal wavelength in a transmission direction of the high-frequency signals; and a sub conductor layer disposed between the main conductor layers so as to be parallel with the main conductor layers, the sub conductor layer being electrically connected with the side-wall through conductor groups;

an overlapped portion defined by the two dielectric waveguide lines being stacked one over the other so that one of the main conductor layers of one dielectric waveguide line and one of the main conductor layers of the other dielectric waveguide line overlap each other;

a coupling window defined by coincident openings in the overlapped main conductor layers;

an end through conductor group, disposed at a distance equal to or less than a wavelength of the high-frequency signals from a center of a length of the coupling window in the transmission direction, conductors of said end through conductor group disposed at intervals of less than one half of the signal wavelength in a direction orthogonal to the transmission direction so as to be electrically connected with the main conductor layers; and an end sub conductor layer disposed between the main conductor layers so as to be parallel with the main conductor layers, and electrically connected to the sub conductor layer and the end through conductor group.

2. The connection structure for dielectric waveguide lines of claim 1, wherein the end through conductor group and end sub conductor layer are disposed at positions which are substantially in an end portion of the coupling window in the transmission direction.

3. The connection structure for dielectric waveguide lines of claim 1, wherein the end through conductor group and end sub conductor layer are disposed at a distance from an end of the coupling window in the transmission direction.

4. A connection structure for dielectric waveguide lines comprising:

two dielectric waveguide lines stacked one over the other so that the transmission directions of high-frequency signals therein are orthogonal to each other, each of said lines comprising:

a dielectric substrate;

a pair of main conductor layers, the dielectric substrate sandwiched between the pair of main conductor layers;

two rows of side-wall through conductor groups arranged in a transmission direction of high-frequency signals at repetition intervals less than one half of a signal wavelength in a transmission direction of high-frequency signals and in a direction orthogonal to the transmission direction at a predetermined width, so as to electrically connect the main conductor layers; and a sub conductor layer disposed between the main conductor layers so as to be parallel with the main conductor layers, the sub conductor layer being electrically connected with the side-wall through conductor groups;

an overlapped portion defined by the two dielectric waveguide lines being stacked one over the other so that one of the main conductor layers of one dielectric waveguide line and one of the main conductor layers of the other dielectric waveguide line overlap each other;

a coupling window defined by coincident openings through the overlapped main conductor layers; and an end through conductor group, provided at a distance equal to or less than a wavelength of the high-frequency signals from a center of a length of the coupling window in the transmission direction of the dielectric waveguide line, conductors of said end through conductor group arranged at intervals less than one half of the signal wavelength in a direction orthogonal to the transmission direction so as to electrically connect the main conductor layers; and an end sub conductor layer disposed between the main conductor layers so as to be parallel with the main conductor layers, electrically connected to the sub conductor layer and the end through conductor group.

5. The connection structure for dielectric waveguide lines of claim 4, wherein a width of the two rows of side-wall through conductor groups of the dielectric waveguide lines in the overlapped portion of the dielectric waveguide lines is larger than the predetermined width.

6. The connection structure for dielectric waveguide lines of claim 4, wherein an interval between the pair of main conductor layers of the dielectric waveguide lines in the overlapped portion of the dielectric waveguide lines is narrower than an interval therebetween in a non-overlapped portion of the dielectric waveguide lines.

* * * * *